US007526822B2

(12) United States Patent
Joyce

(10) Patent No.: US 7,526,822 B2
(45) Date of Patent: May 5, 2009

(54) HOLDERS FOR BEDS

(76) Inventor: Teresa M. Joyce, 8501 Spearman Dr., Austin, TX (US) 78757

( * ) Notice: Subject to any disclaimer, the term of this patent is extended or adjusted under 35 U.S.C. 154(b) by 0 days.

(21) Appl. No.: 11/710,092

(22) Filed: Feb. 22, 2007

(65) Prior Publication Data

US 2007/0192959 A1 Aug. 23, 2007

Related U.S. Application Data

(60) Provisional application No. 60/776,039, filed on Feb. 22, 2006.

(51) Int. Cl.
*A47C 9/02* (2006.01)
*A47C 9/04* (2006.01)

(52) U.S. Cl. ..... 5/485; 5/497

(58) Field of Classification Search ..... 5/485, 5/482, 497, 503.1
See application file for complete search history.

(56) References Cited

U.S. PATENT DOCUMENTS 3,503,391 A * 3/1970 Melges ..... 128/852
4,129,909 A * 12/1978 Riehl ..... 5/503.1
4,736,478 A 4/1988 Dangerously
4,841,588 A 6/1989 Harbin
4,872,228 A 10/1989 Bishop
4,873,734 A 10/1989 Pollard
4,890,345 A 1/1990 Sessa
5,068,936 A 12/1991 Blitzer
5,070,561 A 12/1991 Keidser
5,086,530 A 2/1992 Blake
5,279,009 A 1/1994 Putka, Jr.
5,357,641 A 10/1994 Schubert
5,370,246 A * 12/1994 Traynor ..... 211/86.01
5,375,274 A 12/1994 Cuneo
5,392,477 A 2/1995 Wolter et al.
5,423,098 A 6/1995 Swezey et al.
5,436,053 A 7/1995 Herum
5,452,808 A 9/1995 Abramowitz
5,465,440 A 11/1995 Heptner
5,473,785 A 12/1995 Lager et al.
5,493,742 A 2/1996 Klearman
5,688,349 A 11/1997 Herum
5,755,481 A 5/1998 Emery
5,765,241 A 6/1998 Macdonald
5,819,341 A 10/1998 Simantob et al.

(Continued)

FOREIGN PATENT DOCUMENTS

FR 2617031 * 12/1988

*Primary Examiner*—Alexander Grosz
(74) *Attorney, Agent, or Firm*—David Lewis

(57) ABSTRACT

Set of attachments, including one or more attachments are attached to a portion of bedding for storing an item, such that someone lying in bed may comfortably reach the item while in bed. The set of attachments may include various sorts of holders for holding personal items, such as one or more pockets and/or one or more straps. In an embodiment the bedding is a fitted bed sheet. In other embodiments, the bedding may be other pieces of bedding where the set of attachments may be placed within reach of the person. In an embodiment, the location of the set of attachments is based on an average sized individual of a particular population and the size of the bedding. In another embodiment, the location of the pocket is based on the dimensions of the individual for which the set of attachments is made and on the individual's bedding.

17 Claims, 14 Drawing Sheets

U.S. PATENT DOCUMENTS 5,857,473 A 1/1999 Vanover et al.
5,920,929 A 7/1999 Hensley et al.
5,926,872 A 7/1999 Rossdeutscher
5,983,597 A 11/1999 Venturi et al.
5,987,665 A 11/1999 Simantob et al.
6,044,503 A 4/2000 McClendon
6,059,343 A 5/2000 Emery
6,061,851 A 5/2000 Crowell
6,061,857 A 5/2000 Deneau
6,108,836 A 8/2000 Keene, III
6,128,796 A 10/2000 McCormick et al.
6,148,458 A 11/2000 Hires
6,149,234 A 11/2000 Daniels
6,173,465 B1 1/2001 Deneau
6,178,574 B1 * 1/2001 Stromatt et al. ..... 5/485
6,230,342 B1 5/2001 Haugs
6,233,765 B1 * 5/2001 Verhulst ..... 5/503.1
6,237,171 B1 5/2001 Allen
6,243,896 B1 6/2001 Osuna et al.
6,286,163 B1 9/2001 Trimble
6,347,423 B1 2/2002 Stumpf
6,349,432 B1 2/2002 Scordato et al.
6,389,621 B1 5/2002 Elliott et al.
6,415,466 B1 7/2002 Laiso
6,427,268 B1 8/2002 Davis
6,505,368 B1 1/2003 Elliss et al.
6,532,608 B2 3/2003 Schreiner
6,594,836 B1 * 7/2003 Everson et al. ..... 5/485
6,601,250 B1 * 8/2003 Taylor ..... 5/485
6,631,528 B2 10/2003 Landry
6,668,401 B2 12/2003 Waters
6,681,422 B2 1/2004 Landry
6,694,550 B2 2/2004 Lee
6,802,088 B1 10/2004 Gruner
6,848,130 B1 2/2005 Wilson
6,848,131 B1 2/2005 Landry
6,854,139 B2 2/2005 Lamy
6,857,146 B2 2/2005 Landry
6,952,844 B2 10/2005 Danaher
7,131,152 B2 * 11/2006 Wootten et al. ..... 5/485
2003/0159193 A1 * 8/2003 LeFevre et al. ..... 2/69.5

* cited by examiner

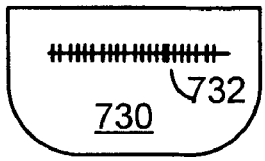
FIG. 7B
FIG. 7C
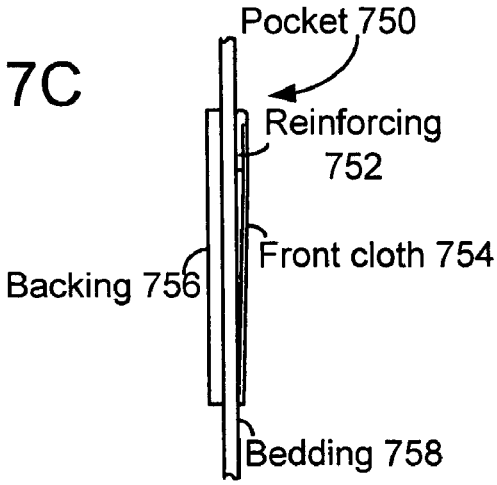
FIG. 7D
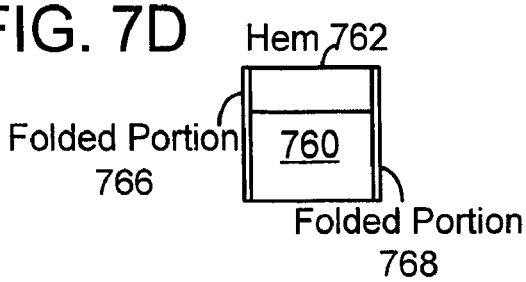
FIG. 7E
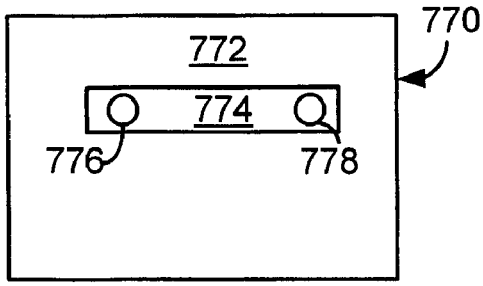

HOLDERS FOR BEDS

CROSS-REFERENCE TO RELATED APPLICATIONS

This application claims priority benefit of U.S. Provisional Patent Application entitled "Holders on Bedsheets for Personal Items," Ser. No. 60/776,039, filed Feb. 22, 2006, by Teresa Joyce, which is incorporated herein by reference.

FIELD

The invention is related to pieces of bedding.

BACKGROUND

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

A variety of sorts of bedding have been designed for people to lie upon. Some of the pieces of bedding that people may use may include mattresses, box springs, sheets, fitted sheets, blankets and bed spreads. While lying in bed people often like to keep a variety of items nearby, such as books, eye glasses, water bottles, and amusement devices, such as toys, puzzles, games, electronic games, mobile phones, and remote controls for televisions or video games. Some people may desire to keep any of these items close by while in bed, so that it is easier to enjoy these items while in bed. Some people may desire to keep one or more safety or security devices nearby, such as an inhalers, mace, a noise making device (e.g., a horn or a whistle), or a Taser®. The person may want to keep the safety device close by for increased protection in case a malicious person visits the person in bed. Additionally, the quality of life for bed ridden people can be improved by having these items close by and easily accessible. Having these items close by may also decrease the degree of dependence that a bed ridden person has on other people.

BRIEF DESCRIPTION OF THE DRAWINGS

In the following drawings like reference numbers are used to refer to like elements. Although the following figures depict various examples of the invention, the invention is not limited to the examples depicted in the figures.

FIG. 7B shows a representation of an example of one type of pocket that may be used within the set of attachments of FIGS. 1A-5.

FIG. 7C shows a representation of an embodiment of a cross-section of a pocket that may be used within the set of attachments of FIGS. 1A-5.

FIG. 7D shows a representation of an embodiment of a back side of a front cloth that may be used to form a pocket within the set of attachments of FIGS. 1A-5.

FIG. 7E shows a representation of an example of a portion of bedding having an embodiment of a set of attachments.

DETAILED DESCRIPTION

Although various embodiments of the invention may have been motivated by various deficiencies with the prior art, which may be discussed or alluded to in one or more places in the specification, the embodiments of the invention do not necessarily address any of these deficiencies. In other words, different embodiments of the invention may address different deficiencies that may be discussed in the specification. Some embodiments may only partially address some deficiencies or just one deficiency that may be discussed in the specification, and some embodiments may not address any of these deficiencies.

In general, at the beginning of the discussion of each of FIGS. 1A-19 is a brief description of each element, which may have no more than the name of each of the elements in the one of FIGS. 1A-19 that is being discussed. After the brief description of each element, each element is further discussed in numerical order. In general, each of FIGS. 1A-21 is discussed in numerical order and the elements within FIGS. 1A-21 are also usually discussed in numerical order to facilitate easily locating the discussion of a particular element. Nonetheless, there is no one location where all of the information of any element of FIGS. 1A-21 is necessarily located. Unique information about any particular element or any other aspect of any of FIGS. 1A-21 may be found in, or implied by, any part of the specification.

Figure 1A:
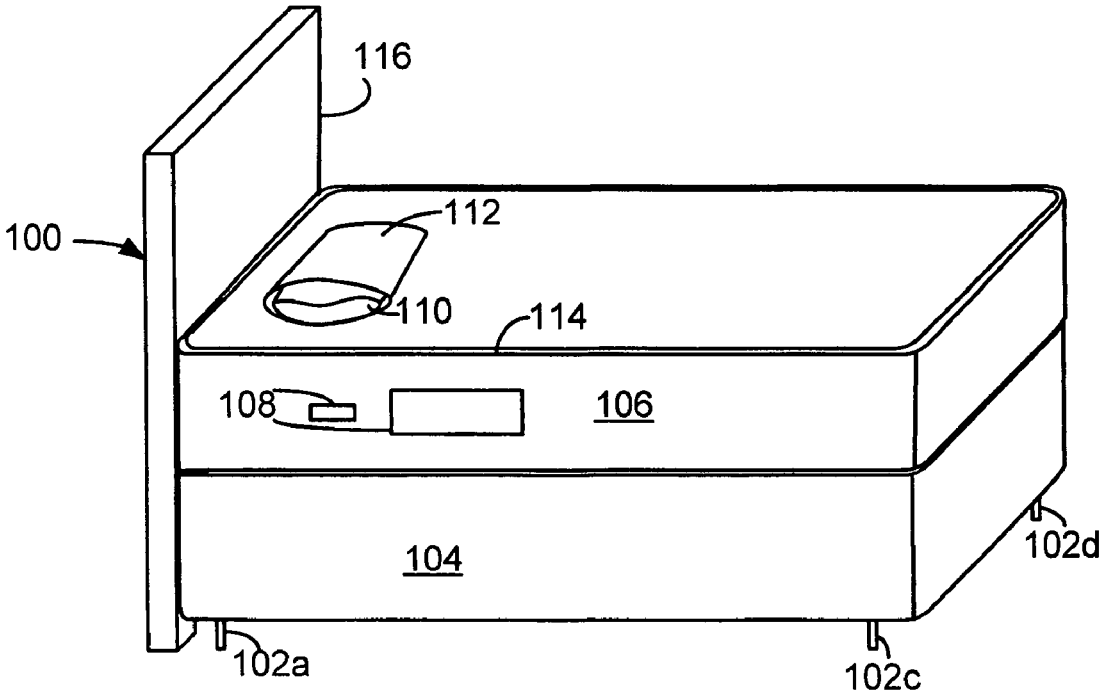
FIG. 1A shows a representation of an example of a bed and a set of attachments according to the invention.

FIG. 1A shows a representation of an example of a bed 100 according to the invention. Bed 100 may include optional legs 102*a-d*, optional box spring 104, and mattress 106, which has set of attachments 108. Bed 100 may also include optional pillow 110, optional pillow cover 112, seams 114, and optional headboard 116. In other embodiments, bed 100 may not have all of the features listed and/or may have other features instead of or in addition to those listed.

Bed 100 is for sitting, sleeping, or lying upon. Bed 100 supports the weight of at least one person. Optionally, bed 100 feels soft and is comfortable to lie and/or sit upon. Although bed 100 is illustrated as having the head and foot as being narrower than the sides, the head and foot maybe wider than the sides of bed 100. Bed 100 may be any of a number of sizes, such as a twin size, queen size, king size, or any of a number of other sizes. Although bed 100 is illustrated as rectangular, bed 100 may be any shape. Bed 100 may be for use in a household, hospital, hotel, hospice, and/or may have other uses.

Optional legs 102*a-d* support bed 100 and raise bed 100 above the ground. Although FIG. 1 only shows legs 102*a*, 102*c*, and 102*d*, bed 100 may also include leg 102*b* under the upper left corner, hidden from view in the perspective of FIG. 1. Although bed 100 is illustrated as having four legs, bed 100 may have fewer than four legs or more than four legs. For example, bed 100 may not have any legs, may have only one leg, may have three legs, may have five legs or any other number of legs. Also, the legs may be located in different locations than illustrated in FIG. 1

Optional box spring 104 (if present) may support a mattress and may include an arrangement of springs. Alternatively, optional box spring 104 may include a configuration of different types of cushions and/or springs or may be an ordinary mattress. In an embodiment optional legs 102*a-d* are attached to box spring 104. In another embodiment, optional legs 102*a-d* are attached to a frame that holds optional box spring 104.

Mattress 106 is for the person to lie upon. In an embodiment, mattress 106 is a cushion. In another embodiment, mattress 106 is an air mattress or a water mattress. Mattress 106 may be covered by a sheet.

Set of attachments 108 are a set of one or more attachments for holding personal items of the person. In an embodiment, set of attachments 108 are located in a position in which it is convenient for the person to reach. The location of the set of attachments may depend upon the dimensions of the people, the agility of the people, and/or the dimensions of portions of the bedding for which the set of attachments are intended. In an embodiment, the pocket is placed in a position for easy access and less stress for a bed ridden person as compared to other positions on the bedding. In an embodiment, attachment 108 may be attached to the sheet that covers mattress 106. In an alternative embodiment, no sheet is used and set of attachments 108 is attached directly to mattress 106. One or more holders for personal items are attached to a fitted sheet. There are a variety of embodiments of different types of holders that are within the scope of this specification. In an embodiment, set of attachments 108 may include a variety of types of holders for personal items, such as pockets, straps, cup holders, or other types of holders of personal items. In one embodiment, the holder is a pocket. In another embodiment the holder is a strap. In yet another embodiment the holder may include one or more pockets and/or one or more straps. The details of set of attachments 108 are discussed further in conjunction with the remaining figures.

Pillow 110 is for the person to rest their head upon while lying upon mattress 106. Pillow 110 may include feathers and/or another soft particulate material, which are enclosed within a soft cloth casing. Pillow 110 may include foam in addition to or instead of the feathers and/or soft particulate material. Alternatively pillow 110 may be an air cushion or water cushion. Pillow 110 may be covered with optional pillow cover 112. Seams 114 may connect a top portion of mattress 106 to side portions of mattress 106. The location of set of attachments 108 may be measured relative to the top of mattress 106. Optional headboard 116 (if present) may be used by a person to lean against while awake in bed. The location of set of attachments 108 may be based on a relaxed positioning of the person's arm while sitting in bed in a relaxed position, which may be on the side of bed 100 around a location (e.g., just beyond or slightly short) of the hips of a person (e.g., an average sized person) sitting in bed while leaning against headboard 116.

Figure 1B:
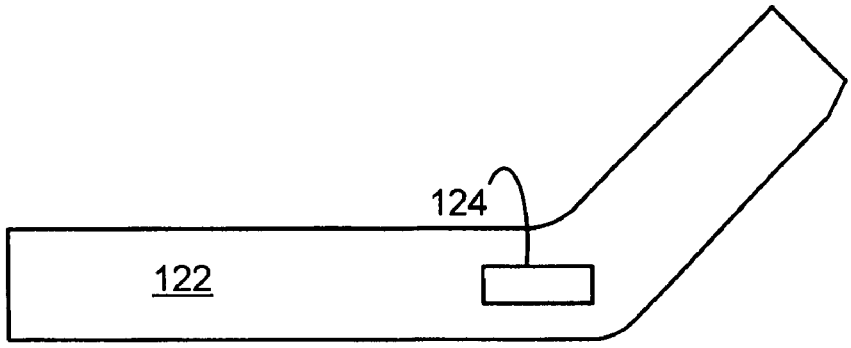
FIG. 1B shows a representation of an example of mattress in a reclined position.

FIG. 1B shows a representation of an example of mattress 122 in a reclined position. Mattress 122 has set of attachments 124. In other embodiments, bed 122 may not have all of the features listed and/or may have other features instead of, or in addition to, those listed. Mattress 122 may be adjustable to recline or lay flat. Mattress 122 may be located on top of a reclining bed, such as a hospital bed, and may be in the reclined position as a result of the bed being in a reclined position. Set of attachments 122 may be located directly on mattress 122, on a fitted or other bedding on mattress 122, or on another piece of bedding associated with mattress 122. Set of attachments 124 is located at the point where the mattress folds while inclined upwards or on a piece of bedding (e.g., a fitted sheet) at the point that is expected to be located at the fold in mattress 122 while mattress 122 is inclined.

Figure 2:
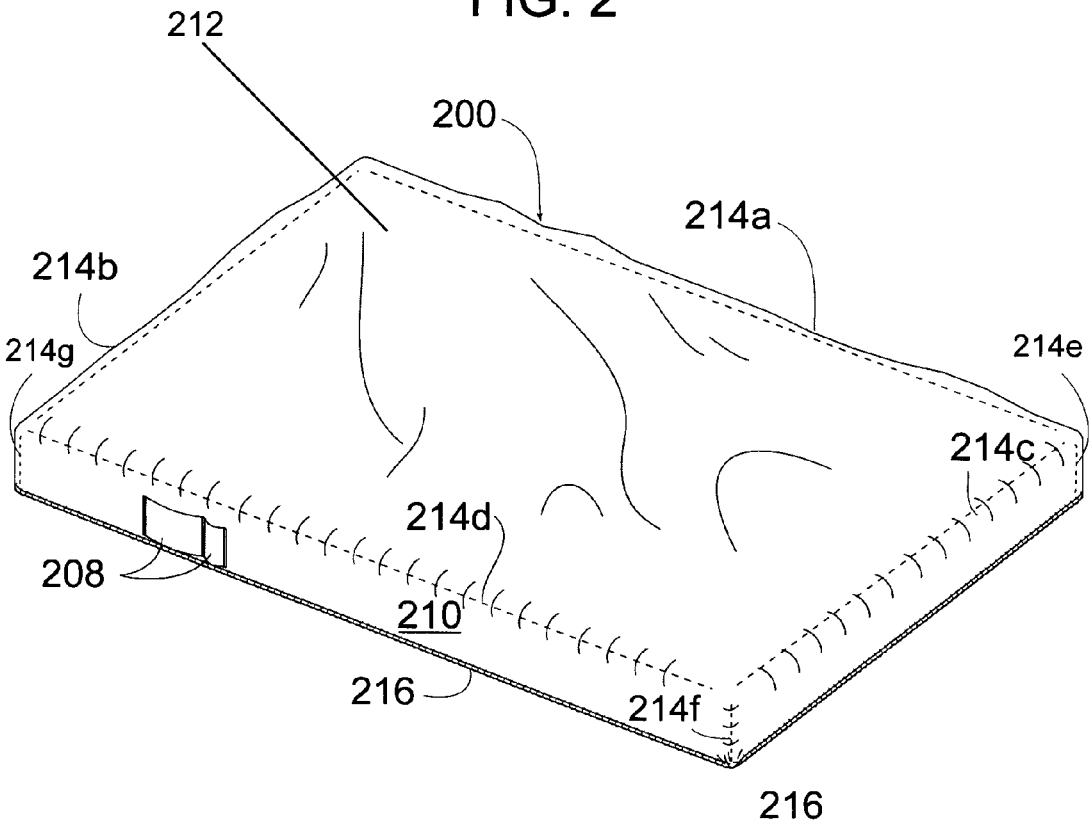
FIG. 2 shows a representation of an example of a fitted sheet having the set of attachments.

FIG. 2 shows a representation of an example of a fitted sheet 200 having the set of attachments. Fitted sheet 200 has set of attachments 208 attached to side portion 210. Fitted sheet 200 includes top portion 212 and folds 214*a-g* and elastic 216. In other embodiments, fitted sheet 200 may not have all of the features listed and/or may have other features instead of or in addition to those listed.

Fitted sheet 200 is shaped to fit on a mattress of a particular set of dimensions (e.g., a particular thickness, width, and length). Fitted sheet 200 may be less likely to slip off of the mattress than a sheet that is not fitted. Set of attachments 208 may be the same as set of attachments 108, which were explained in conjunction with FIG. 1 (and which will be discussed further in the remainder of this specification). In an embodiment, a piece of fabric may be sewn to the fitted sheet to form a pocket (which is one type of holder that may be included in the set of attachments). Top portion 212 is the portion of fitted sheet that is placed on the top of a mattress. Folds 214*a-g* are places where sections of sheet 200 that correspond to different sides of the mattress meet and are attached to one another. For example, folds 214*d* connect side 210 to top 212. Similarly, folds 214*a-c* connect side portions to top 212, and folds 214*e-g* connect different side portions to one another. Folds 214*a-d* may be indicative of the location of the seams of the mattress for which fitted sheet 200 is attached. In an embodiment, folds 214*a-d* are continuous portions of fabric that have no particular fold until fitted sheet 200 is placed on a mattress.

Similarly, in an embodiment, the top portions of folds 214*e-g* are also continuous portions of material that do not show any fold until fitted sheet 200 is placed on a mattress, while the bottom portions of folds 214*e-g* may be seams. In alternative embodiments, any portion of folds 214*a-g* may be seams or continuous portions of material. The location of set of holder 208 may be measured in-part with respect to folds 214*b* and/or 214*d*. There is an eight fold on the portion of the corner of the bed that is hidden from view, which may be referred to as fold 214*h*. Hidden fold (214*h*) is the same as folds 214*e-g*.

Elastic 216 is attached to bottom portions of the sides of fitted sheet 200. Elastic 216 stretches to allow fitted sheet 200 to be placed over and around a mattress. Elastic 216 may tend to pull the edges of fitted sheet 200 under the mattress. Elastic 216 aids in holding fitted sheet 200 on the mattress. In one embodiment, the side-pocket or medical side-pocket are sewn on a full-size fitted sheet (e.g., a full-size twin bed fitted sheet) or on any other size sheet (e.g. full king size or queen size fitted sheet).

Figure 3:
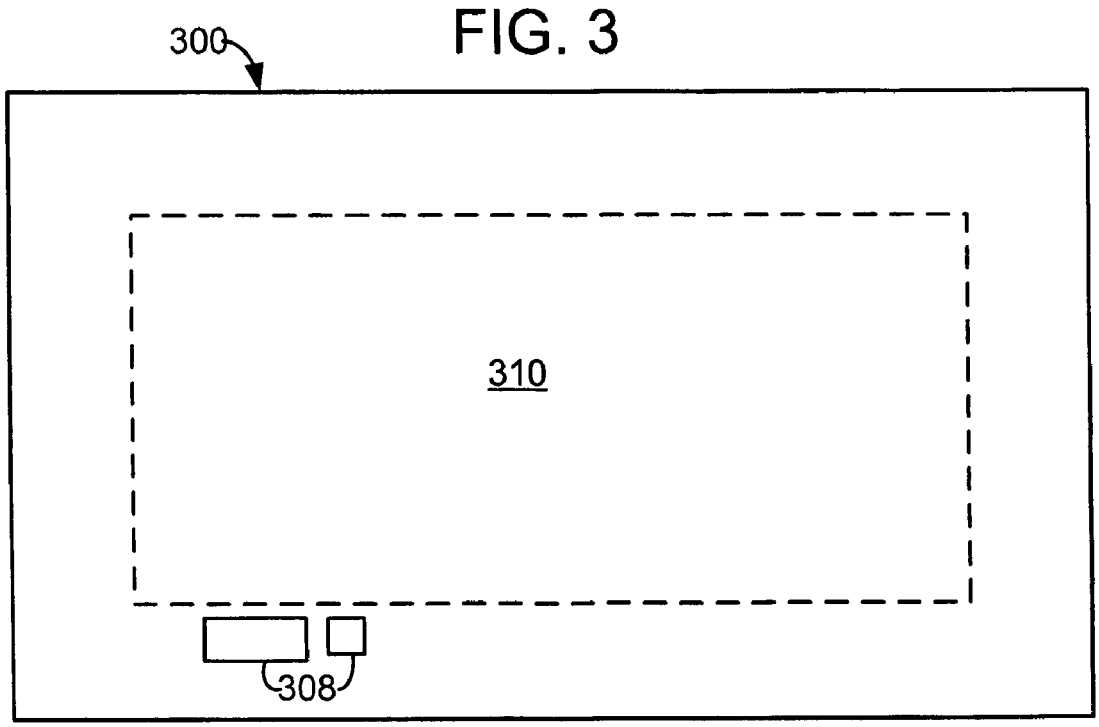
FIG. 3 shows a representation of an example of another sheet having the set of attachments.

FIG. 3 shows a representation of an example of another sheet 300 having the set of attachments. Sheet 300 has set of holders 308 (the set of attachments) and top portion 310. In other embodiments, sheet 300 may not have all of the features listed and/or may have other features instead of or in addition to those listed.

Set of holder 308 may be the same as set of attachments 108, which were discussed in conjunction with FIG. 1. Top portion 310 is a portion of sheet 300 that is expected to be on top of a mattress when the mattress is covered with sheet 300.

Figure 4:
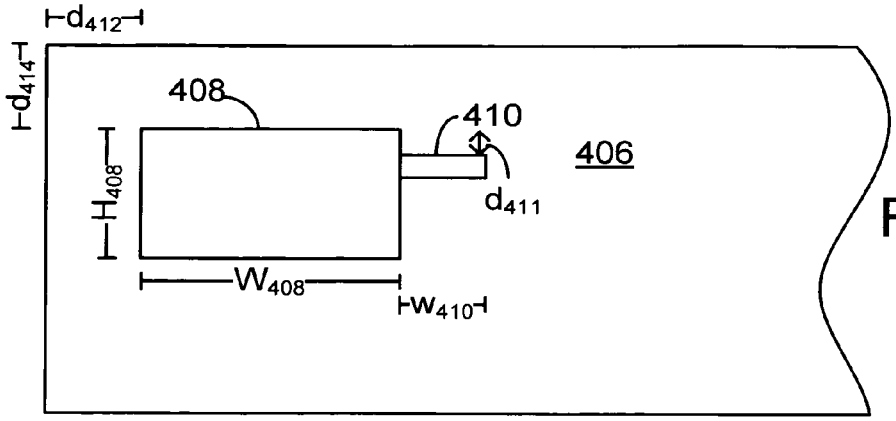
FIG. 4 shows a representation of an example of a portion of bedding having a set of attachments.

FIG. 4 shows a representation of an example of a portion of bedding (which may be referred to as bedding portion 406). Bedding portion 406 may include pocket 408 having height $H_{408}$ and width $W_{408}$ and strap 410 having width $W_{410}$. Bedding portion 406 may also be associated with distances $d_{411}$, $d_{412}$, and $d_{414}$. In other embodiments, bedding 406 may not have all of the features listed and/or may have other features instead of or in addition to those listed.

Bedding portion 406 may be a portion of side 106 of mattress 100, side 206 of fitted sheet 200 or of sheet 300. Bedding portion 406 is a portion of the bedding that is located at an edge of the mattress at which the user is expected to place their head. Whether the edge at which the user is expected to place their head is on the left or right is not important. If the head is expected to be to the right of FIG. 4 instead of the left, then the components of bedding portion 406 are arranged in the opposite order to form a mirror image of FIG. 4. The same applies to all of the embodiments described in this specification.

Pocket 408 is a single pocket, which in an embodiment is made from a mesh material. In an alternative embodiment, pocket 408 is made from a solid material. Pocket 408 has a width of $W_{408}$ and a height of $H_{408}$. In an embodiment, width $W_{408}$ is wide enough to hold one or more items of interest, such as a book, a defensive device (e.g., a Taser® or can of mace), or other item. In an embodiment, width $W_{408}$ is narrow enough so that a person that is lying in bed can easily reach items at the farther end of the pocket and/or so that the person's hand is directed to a location that is reasonably close to the items of interest. In an embodiment, width $W_{408}$ is 10 inches to 30 inches. Other embodiments of pocket 408 are further described in conjunction with at least FIGS. 6 and 7F.

Figure 18:
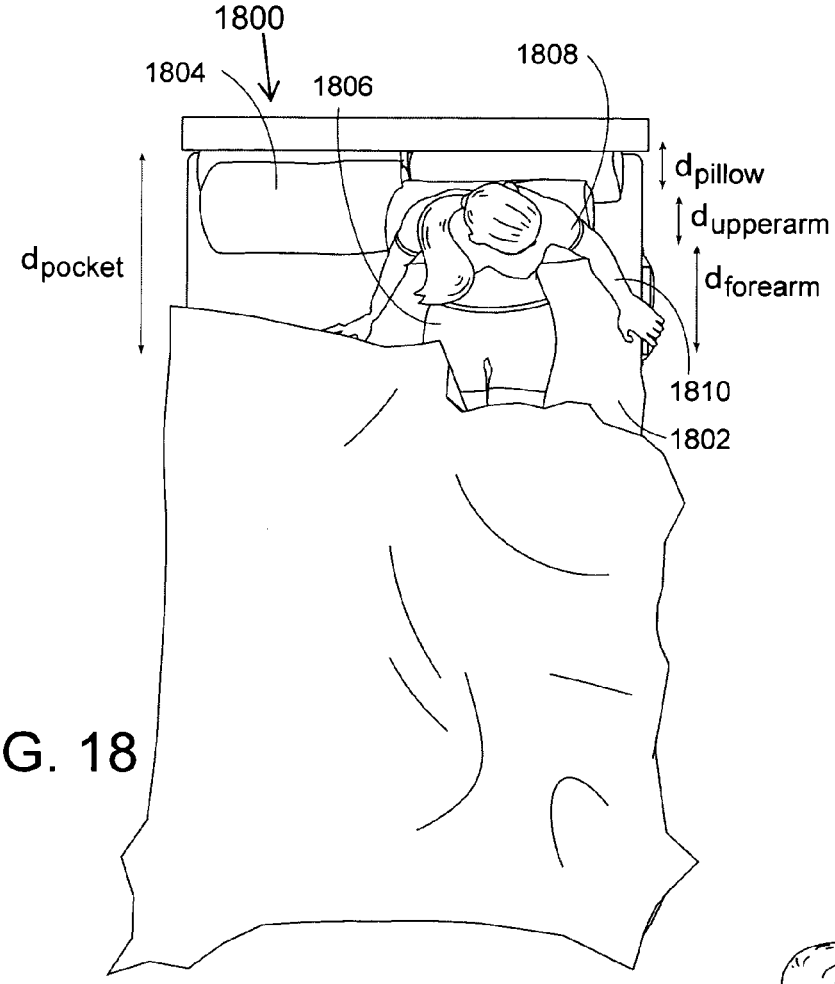
FIG. 18 shows a top view of a representation of an example of a scenario in which a person is using a set of attachments.
Figure 19:
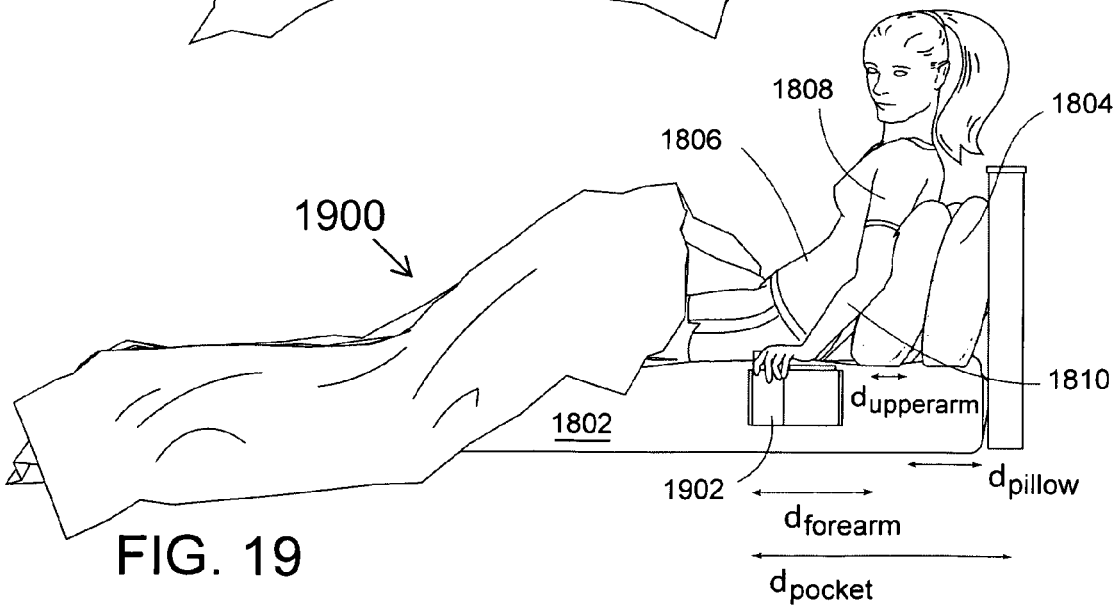
FIG. 19 shows a side view of the representation of the scenario of FIG. 18.

In an embodiment, height $H_{408}$ is high enough to securely hold the expected items of interest, but is short enough so that the person can reach the bottom without having to sit up beyond a reclined position (the reclined position is discussed further in conjunction with FIGS. 18 and 19). Alternatively, in another embodiment, the person can reach the top of the pocket without sitting up from a reclined position. Alternatively, in another embodiment, the person can reach the bottom of the pocket without sitting up. In an embodiment height $H_{408}$ may be 1 inch to 2 inches. In other embodiments, height $H_{408}$ and width $W_{408}$ may be of other distances.

Strap 410 is a band of material for holding another item of interest, which may be better held in place by a strap and/or easier to place in or take out of a strap than a pocket. For example, strap 410 may be for holding a set of glasses. In the embodiment of FIG. 4, pocket 408 is located between strap 410 and the closer edge of a mattress (the closer of the head and the foot of the mattress). Width $W_{410}$ is a width that is appropriate for holding the item of interest that is expected to be placed in strap 410. Width $W_{410}$ may be determined by the item of interest that is expected to placed in strap 410. In an embodiment, width $W_{410}$ is 2 inches to 6 inches.

The distance $d_{411}$ is the distance from the top of the pocket 408 to the top of strap 410, which may be 1 inch to 2 inches. Distance $d_{414}$ is a distance from the expected location of the top of the mattress and pocket 408. Distance $d_{412}$ is a distance between an edge of pocket 408 and an end of the mattress. Distance $d_{412}$ and $d_{414}$ are determined such that a person of expected dimensions can access the items of interest without sitting up in bed. For example, distances $d_{412}$, and $d_{414}$ may be based on the average dimension of a particular population of people. The population of people may be based on an age group, a location, genetic dispositions, and/or racial features. For example, bedding material intended for children of one particular age group may have different values for distance $d_{412}$ and $d_{414}$ than bedding material intended for another age group or other populations. The pockets of this specification may be a range of different sizes depending on the embodiment. A large pocket allows for more maneuverability, which may be desirable for those having hands that lack dexterity. However, items that are in a small pocket are easier to find, because there are fewer possibilities of where the item may be located, which may be desirable for people that cannot move easily within the bed and/or have poor finger dexterity. When the sheet is on the bed, the opening of the pocket closes naturally as a result of the tension created by being held to the mattress.

The pockets and/or straps on the beddings above may be of an appropriate size and durability for holding glasses, toys, books, other amusement items, writing utensils (e.g., pens or pencils), flashlights, cosmetic items (such as eye liner, nail polish, lipstick), food items, drinks (e.g., a water bottle or juice box), and/or safety items (such as mace, a gun, horn, whistle, cell phone, or a Taser®).

As another example, distances $d_{412}$ and $d_{414}$ may be customized to the dimensions of an individual person and the bed and/or the sleepwear that the person is expected to use. Optionally, bedding portion 406 may include other straps and/or pockets in addition to or instead of pocket 408 and strap 410.

Figure 5:
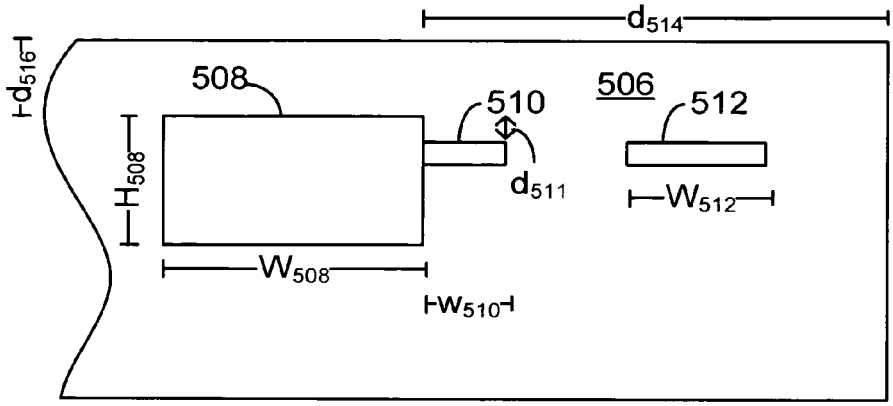
FIG. 5 shows a representation of an example of another portion of bedding having the attachments.

FIG. 5 shows a representation of an example of a bedding portion 506. Bedding portion 506 may include pocket 508 having height $H_{508}$ and width $W_{508}$, strap 510 having width $W_{510}$, and strap 512 having width $W_{512}$. Bedding portion 506 may also be associated with distances $d_{511}$, $d_{514}$, and $d_{516}$. In other embodiments, bedding portion 506 may not have all of the features listed and/or may have other features instead of or in addition to those listed.

Pocket 508, height $H_{508}$, width $W_{508}$, strap 510, width $W_{510}$, distance $d_{511}$, distance $d_{514}$, and distance $d_{516}$ may be the same as pocket 408, height $H_{408}$, width $W_{408}$, strap 410, width $W_{410}$, distance $d_{411}$, distance $d_{412}$, and distance $d_{414}$, respectively, which were discussed above in conjunction with FIG. 4, except that pocket 408 is between strap 410 and the closer edge of the bedding, whereas strap 510 is between pocket 508 and the closer edge of the bedding. Additionally, portion of bedding 508 has strap 512, which may be suited for holding a different type of item than strap 510. Consequently, width $W_{512}$ may be of a different width than width $W_{510}$, according to the widths of the respective items that each is intended to hold. In an embodiment, width $W_{512}$ (similar to width $W_{510}$) may be between 2 inches and 6 inches.

In an embodiment, pockets 408 and 508 have only a single section (e.g., only a single compartment or pocket). In another embodiment, pockets 408 and 508 may be divided into multiple pockets (e.g., 2, 3 or more). Some embodiments of pockets 408 and 508 in which the pockets are divided into multiple pockets are discussed in conjunction with FIGS. 6-7G. In an embodiment, the pocket is made from a rectangular piece of fabric that matches (e.g., is coordinated) with the pattern and/or color of the rest of the sheet or other bedding to which the pocket is attached.

In one embodiment, the pockets described in this specification are made from one piece of fabric sewn so that the pocket is flush to a bedding portion, such as a fitted sheet, when the bedding portion is on the bed. In another embodiment, two or more adjacent pockets are sewn from two or more pieces of material. In yet another embodiment, there are multiple pockets placed in different places on the sheet any of which may be adjacent to or separated from others of the pockets.

Figure 6:
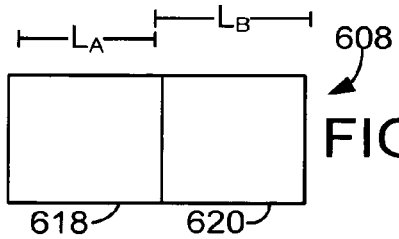
FIG. 6 shows a representation of an example of one type of pocket that may be used within the set of attachments of FIGS. 1A-5.

FIG. 6 shows a representation of an example of one type of pocket 608 that may be used within the set of attachments of FIGS. 1A-5, such as for pocket 408 or 508. Pocket 608 may include sections 618 and 620 having lengths $L_A$ and $L_B$, respectively. Pocket 608 has two sections instead of just one. Length $L_A$ may be greater than, the same as, or smaller than length $L_B$. In other embodiments, pocket 608 may not have all of the features listed and/or may have other features instead of or in addition to those listed. In one embodiment, a section is stitched to create a larger packet in which $L_A$ (or $L_B$) is 9" to 25" wide and an additional smaller pocket in which $L_B$ (or $L_A$) is 5" to 8" wide.

Figure 7A:
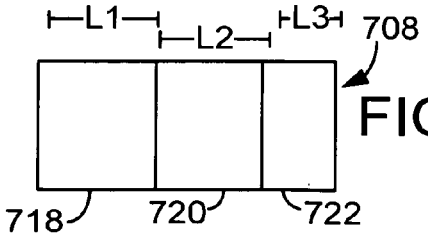
FIG. 7A shows a representation of an example of one type of pocket that may be used within the set of attachments of FIGS. 1A-5.

FIG. 7A shows an example of one type of pocket 708 that may be used for pocket 408 or 508. Pocket 708 may include sections 718, 720, and 722 having lengths $L_1$, $L_2$, and $L_3$, respectively. Pocket 708 has three sections instead of just the one depicted in FIGS. 4 and 5. Length $L_1$ may be greater than, the same as, or smaller than length $L_2$ and $L_3$. Similarly, length $L_2$ may be greater than, the same as, or smaller than length $L_1$ and $L_3$, and length $L_3$ may be greater than, the same as, or smaller than length $L_1$ and $L_2$. In other embodiments, pocket 708 may not have all of the features listed and/or may have other features instead of or in addition to those listed.

In an embodiment of FIG. 6 and FIG. 7A, pocket 608 and 708 may be formed from one segment of material that is sewn or otherwise segmented into multiple compartments. In another embodiment, pockets 608 or 708 are formed from multiple segments (each being a separate piece of material) sewn or otherwise attached to the sheet or other bedding side-by-side to one another.

FIG. 7B shows a representation of an example of one type of pocket 730 that may be used within the set of attachments of FIGS. 1A-5. Pocket 730 has zipper 732, and pocket 730 may be used for pocket 408 or 508. Pocket 730 has one section, but has rounded corners instead of square corners and may be made for a mesh material. Any of the pockets of this application may use a mesh material. A mesh material allows dirt to fall out and therefore is less likely to accumulate dirt and bacteria. Alternatively another material may be used for pocket 732. Similarly, rounded corners are less likely to collect or otherwise accumulate dirt or bacteria, and therefore may be more appropriate for sterile environments or institutional environments, such as a hospital. In an embodiment the corners of the pocket are rounded to prevent the accumulation of dirt and bacteria. Any of the pockets disclosed in this specification may have rounded corners instead of the square corners depicted in the figures. In another embodiment, the pocket has a different shape, such as a half circle, half oval, or a triangle, for example. In other embodiments, pocket 730 may not have all of the features listed and/or may have other features instead of or in addition to those listed. Zipper 732 is an alternative to having the pocket open at the top. Pocket 730 may have an open top or another mechanism of opening and closing instead of zipper 732. Any of the pockets of this specification may use a zipper or other mechanism for opening and closing the pocket.

In an embodiment in which the holder is a pocket, such as pockets 408, 508, 608, 708, or 730, the pocket may open and close at a top portion of the pocket. In an embodiment, the piece of fabric is sewn so that it is flush with the bedding (e.g., a sheet, blanket, bed spread, or a portion of a mattress).

Pockets 408, 508, 608, 708, and 730 may be used for clipping pens or glasses. Optionally, a band or loop may be attached to the outside or inside of any of pockets 408, 508, 608, 708 or 730. Pockets 408, 508, 608, 708 and 730 may be referred to as "Ergo Pockets," because the placement on the side of the bed is ergonomic for a bed ridden person. However, embodiments of the pockets may also be designed for and/or used by a healthy individual and that may not be ergonomic for a bed ridden person.

FIG. 7C shows a representation of an example of a cross-section of a pocket 750. Pocket 750 may include reinforcing 752, front cloth 754, optional backing 756, and bedding 758. In other embodiments, cross-section of pocket 750 may not have all of the features listed and/or may have other features instead of or in addition to those listed.

Reinforcing 752 may be a hem, piece of cloth, a leather band, or an elastic band. Reinforcing 752 may be a fold at the top of the pocket to reinforce the top of the pocket, so that the pocket is less likely to tear at the top. No matter how reinforcing 752 is made, reinforcing 752 may reduce the likelihood of the top to the pocket tearing.

Front cloth 754 is a piece of cloth that is attached to the bedding to form pocket 750. Reinforcing 752 is located at the top of front cloth 754.

Optional backing 756 is a piece of material attached to the back of the bedding to reinforce the bedding holding front cloth 754 in place. Optional backing 756 may be sewn to the side of the sheet or other bedding that is expected to face the bed. Optional backing 756 is placed so that it is opposite the pocket (inside the sheet) formed by the bedding and front cloth 754. Optional backing 756 may support the weight of the pocket, to relieve stress on front cloth 754, and to create a bondable surface to which to sew the pocket. Optional backing 756 may reinforce the pocket area. In an embodiment, optional backing 756 may be made from a material sold by the name Thermolan Plus under the brand name Pellon, having a thickness that in the fabric industry is referred to as medium or heavy. In an embodiment, optional backing 756 may be made from the same materials commonly used for bed sheets. The material of optional backing 756 may be doubled to add strength.

A durable thread may facilitate having a secure stitch. In an embodiment the thread may be made from cotton, fleece, linen, polyester, or nylon thread, for example. In an embodiment, the thread is made from 100% nylon, T26, sold as upholstery thread under the brand name Coats and Clark, CA0001. In another embodiment, a blend of polyester and cotton is used for the thread, which is sold as "heavy." In another embodiment a blend of polyester and nylon may be used for the thread. In an embodiment, another material is used that has an equivalent or greater strength than the polyester nylon blend, the polyester cotton blend, or the nylon thread.

Bedding 758 is a portion of a sheet or other type of bedding to which pocket 750 is attached. Optional backing 756 (if present) is attached to one side of bedding 758 (the side that faces the bed or is more difficult to reach while in bed), and front cloth 754 is attached to the other side of bedding 758 (the side that faces away from the bed or is easier to reach while in bed).

FIG. 7D shows a representation of an embodiment of a back side 760 of a front cloth that may be used to form a pocket within the set of attachments of FIGS. 1A-5, such as front cloth 754. Back side 760 may include hem 762 (or another reinforcing), folded portion 766, and folded portion 768. In other embodiments, the back side 760 may not have all of the features listed and/or may have other features instead of or in addition to those listed.

Back side 760 may be an embodiment of the back of front cloth 754. Hem 762 is a fold at the top of back side 760 that is attached to back side 760. Hem 762 may be an embodiment of reinforcing 752. If a hem is used for reinforcing, the hem of the pocket may be ¼" long. Folded portions 766 and 768 are portions at the edges of the back side 760 that are folded and then attached (e.g., sewn) to back side 760. Pocket 750 may be formed by attaching (e.g. sewing) back side 760 to bedding 758 at folded portions 766 and 768. Folded portions 766 and 768 reinforce the location where the front cloth is attached to the bedding. In other embodiments, other reinforcing may be used instead of folded portions 766 and 768.

FIG. 7E shows a representation of an example of a portion of bedding having an embodiment of holder 770, as the set of attachments. Holder 770 has bedding portion 772 having strap 774 with tacks 776 and 778. In other embodiments, holder 770 may not have all of the features listed and/or may have other features instead of or in addition to those listed.

In an embodiment, a piece of strapping forms a loop attached to bedding portion 772, thereby forming strap 774. Bedding portion 772 may be a pocket, which may be an embodiment of pocket 408 and 508. Strap 774 is attached to the front of bedding portion 772. In an alternative embodiment, bedding portion 772 may be a portion of a sheet, mattress or other bedding and/or the strap may be sewn on or attached in another manner.

Figure 7F:
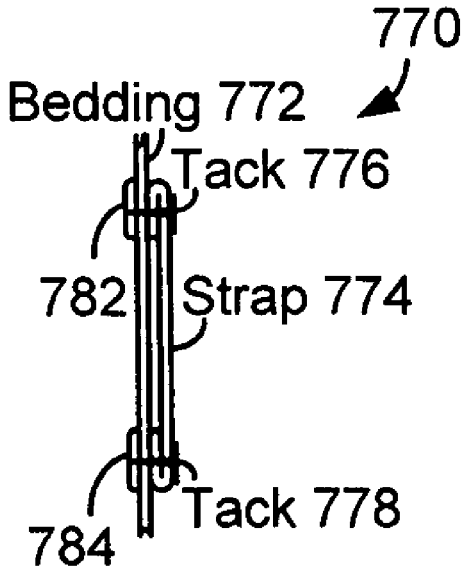
FIG. 7F shows a representation of an example of a cross-section of an embodiment of a holder.

FIG. 7F shows a representation of an example of a cross-section of an embodiment of a holder 770 having bedding portion 772 having strap 774 with tacks 776 and 778 and tack receptors 782 and 784. In other embodiments, holder 770 may not have all of the features listed and/or may have other features instead of or in addition to those listed.

Holder 770, bedding portion 772 (which may be the front cloth of a pocket), strap 774, and tacks 776 and 778 were discussed above in FIG. 7E. However, the cross-section shows an embodiment in which the edges of strap 774 are folded for reinforcing strap 774. Tack receptors 782 and 784 receive and hold the ends of tacks 776 and 778 securely so that tacks 782 and 784 stay in place.

Figure 7G:
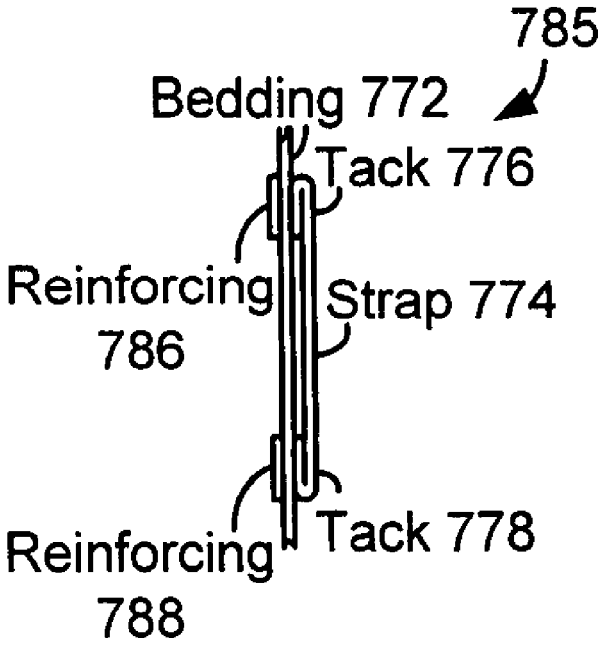
FIG. 7G shows a representation of an example of a cross-section of an embodiment of a holder.

FIG. 7G shows a representation of an example of a cross-section of an embodiment of a holder 785 having bedding portion 772 having strap 774 with tacks 776 and 778 and reinforcings 786 and 788. In other embodiments, holder 785 may not have all of the features listed and/or may have other features instead of or in addition to those listed.

Bedding portion 772 and strap 774 were discussed above in conjunction with FIGS. 7E and 7F. Holder 785 is similar to holder 770. However, the strap 774 is not tacked on, but is sewn on to bedding portion 772. Reinforcings 786 and 788 are optional, but (if present) reinforce bedding portion 772 so that bedding portion 772 is less likely to tear. In an embodiment, strap 774 may be sewn to reinforcings 786 and 788.

In an embodiment of any of the holders of this specification, a strength of thread is used that has a durability adequate for supporting the backing and the types of items for which the holder is intended. The durability of the thread may be determined by industry standard that relates to the thickness of the backing.

Different embodiments of the pocket or other holder will have different dimensions. There are multiple embodiments for the placement of the pockets or other holders. There are multiple embodiments of the pocket and other holders that vary from one another in size and style. The dimensions used in this specification can in general be varied by an eighth of an inch to obtain other embodiments without significantly affecting ease of use for a bed ridden person. Multiple embodiments also may exist that differ in their style. Embodiments of the bed sheets and other beddings that may be used may also vary according to size, shape, and style.

In an embodiment, the straps described above are 2" in length and are placed 1" to 2" (e.g., 1") lower than the top edge of the pocket. One edge of the strap attaches to the edge of the pocket that is closer to the part of the sheet that is intended to be placed at the head of the bed (the head of the bed may be an end of the bed that has the headboard or where the pillow is placed). The strap extends away from the pocket such that the other edge of the strap is 2" to the side of the pocket such that the other edge of the strap is 2" away from the pocket. In another embodiment, the strap may be 2" to 6" (e.g., 4") in length. In another embodiment, there is a second strap in addition to, or instead of, the first strap that is closer to the part of the sheet that is expected to be at the head of the bed than the first strap. The second strap may be 2" to 6" wide and may be located such that there is a space of 2" to 6" between the second strap and the pocket.

Straps may be ⅛" to ½" (e.g., ¼") in height. There may be a strap on the pocket, but the strap adds more stress to the pocket when located on the pocket. In an embodiment, the straps may be tacked from the inside of the sheet or pocket so that the strap is less likely to fall off the sheet or other bedding than were the strap sewn on. In another embodiment, the strap is sewn on.

In an embodiment, the length of the pocket is 5" to 7" in depth (which may also be referred to as height). For example, the pocket may be 5", 6½", or 7" in height or is another height. In an embodiment, the width of the pocket may be 1" to 20" (e.g., 10", 14½", or 19"). In another embodiment, the pocket may be any width up to being as wide as the length of the sheet and any height up until being as high as the thickness of the mattress for which the sheet is designed.

A 5" pocket is a good size for storing mace or a horn. Books, amusement items, and Tasers® may be stored in an 8½", 9½", 10", 14½" or 15" pocket. Glasses, writing utensil, and pen lights may be stored in a 2" strap. Water bottles may be stored in a 4" or 6" strap. In an embodiment, the pocket is divided into two pockets—one pocket has a width of 5", the other pocket, which is closer to the edge, has a length of 9½, and the pocket has a depth of 7". In another embodiment there are two adjacent pockets, each having a width of 9½. In another embodiment, there are three pockets, two having a width of 5" and one having an 8½" width in which the pocket that is 8½" in width is closer to the head of the bed. In another embodiment, the pocket may be divided into three pockets, which are 15", 8" or 8½", and 5" wide in which the pocket that is 8 or 8½" in width is closer to the head of the bed. In another embodiment, the pocket has a width of 14½", and a height of 7". In an embodiment, the pocket has a width of 10" and a height of 5", which is good for use by people having limited mobility and poor finger dexterity.

In an embodiment, the strap is placed on a side of the bed at a position such that the edge of the strap that is closest to the head of the bed is 18" to 21" (e.g., 18" or 19") from a corner that is expected to be placed at the head of the bed. In another embodiment, the closest edge of the pocket is 18" plus or minus 5" from the head corner. For example, there may be an 11" space from the head corner followed by a 4" strap, followed by a 2" space, followed by a 2" strap. As another example, there may be an 11" space followed by a 6" strap followed by a 2" space followed by the pocket. In yet another example, there may be a 16" to 18" space followed by a 2" strap followed by the pocket.

In an embodiment, the top of the pocket may be placed 1" to 1½" below the top seam of the sheet (where the top seam is at the top of the mattress when the sheet is on the bed). If the part of the mattress is less than 8½ inches tall, the pocket may extend from 1" to 1½" from the top seam to the bottom of the elastic of the fitted sheet. Alternatively, the pocket may only extend to a point on the sheet near the bottom elastic that is far enough above the bottom elastic that the pocket is unlikely to extend under the mattress. For example, if a mattress has depth of 4", then the pocket can only be 2½" depth instead of standard).

Figure 8:
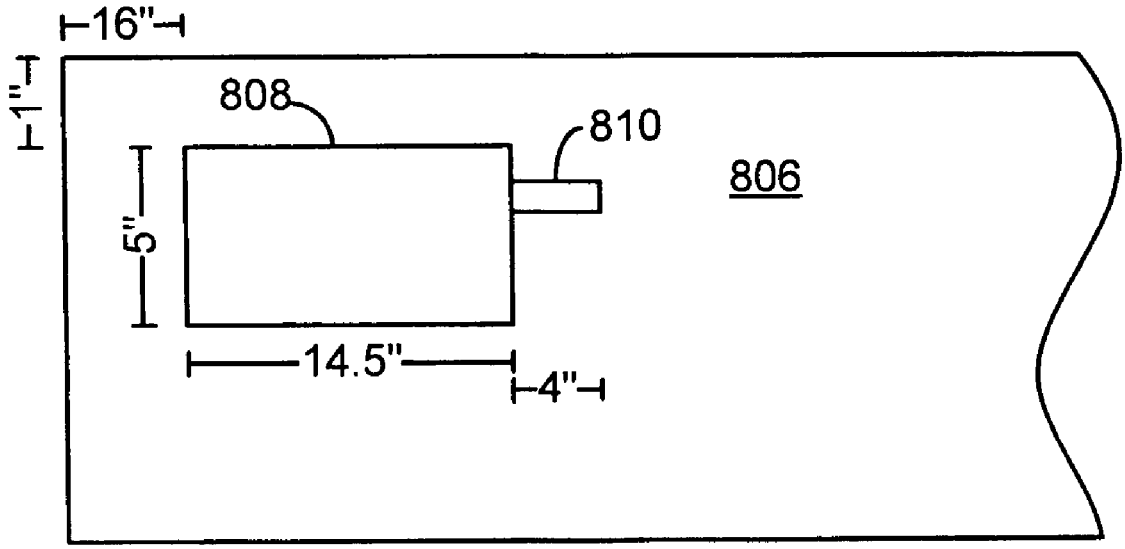
FIG. 8 shows a representation of an example of a portion of bedding having an embodiment of a set of attachments.

FIG. 8 shows a representation of an example of a bedding portion 806 having an embodiment of a set of attachments. Bedding portion 806 includes pocket 808 and strap 810. In other embodiments, bedding portion 806 may not have all of the features listed and/or may have other features instead of or in addition to those listed.

Bedding portion 806, pocket 808, and strap 810 are embodiments of bedding portion 406, pocket 408, and strap 410, respectively, described in conjunction with FIG. 4. In FIG. 8, the distance from the top of the bed to pocket 808, $d_{411}$ (FIG. 4), is one inch, and the distance from the head of the bed (the closer end) to pocket 808, $d_{414}$, is 16 inches. Similarly, the width of pocket 808, $W_{408}$ (FIG. 4), is 14.5 inches and the height of pocket 808, $H_{408}$ (FIG. 4), is 5 inches. Also, the width of strap 810, $W_{410}$ (FIG. 4), is 4 inches. Pocket 808 is positioned at a distance from the end of the bed and has a height that is expected to be comfortable for an average sized child.

Figure 9:
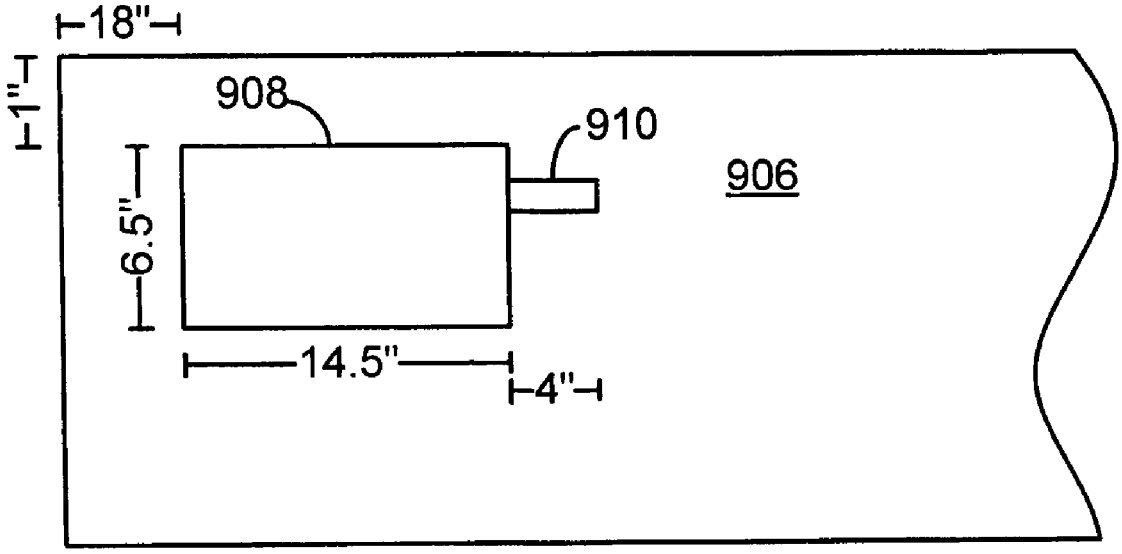
FIG. 9 shows a representation of an example of a portion of bedding having an embodiment of a set of attachments.

FIG. 9 shows a representation of an example of a bedding portion 906 having an embodiment of a set of attachments. Bedding portion 906 includes pocket 908 and strap 910. In other embodiments, bedding portion 906 may not have all of the features listed and/or may have other features instead of or in addition to those listed.

Bedding portion 906, pocket 908, and strap 910 are embodiments of bedding portion 406, pocket 408, and strap 410, respectively, described in conjunction with FIG. 4. Pocket 908 and strap 910 are similar to pocket 808 and strap 810. Specifically, similar to FIG. 8, the distance from the top of the bed to pocket 908, $d_{411}$ (FIG. 4), is one inch, and the width of pocket 908, $W_{408}$ (FIG. 4), is 14.5 inches. However, in contrast to bedding portion 806, in bedding portion 906, the distance from the closer end of the bed to pocket 908, $d_{414}$ (FIG. 4), is 18 inches, and the height of pocket 908, $H_{408}$ (FIG. 4), is 6.5 inches. Pocket 908 is positioned at a distance from the end of the bed and has a height that is expected to be comfortable for an average sized adult.

Figure 10:
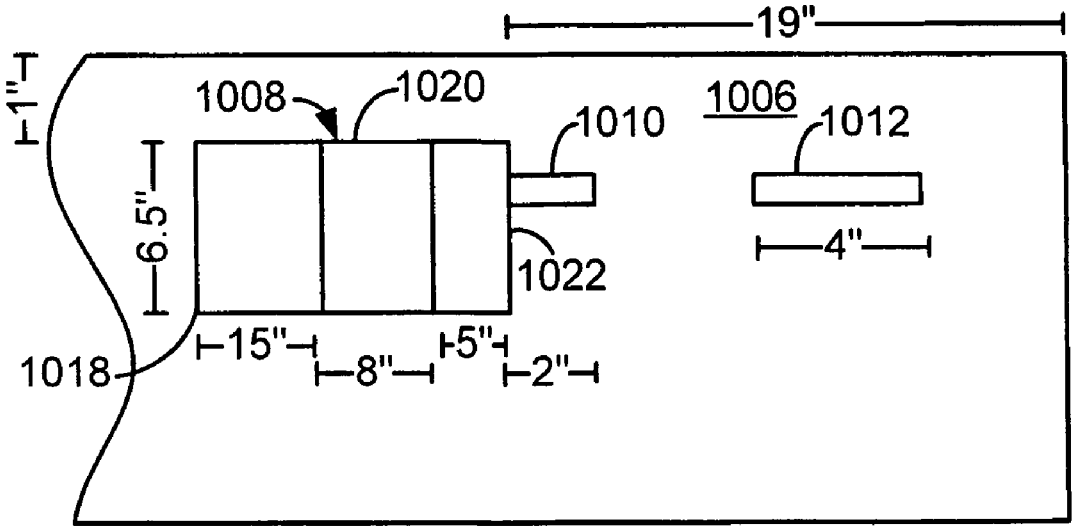
FIG. 10 shows a representation of an example of a portion of bedding having an embodiment of a set of attachments.

FIG. 10 shows a representation of an example of a bedding portion 1006 having an embodiment of a set of attachments. Bedding portion 1006 includes pocket 1008 and strap 1010, strap 1012, sections 1018, 1020 and 1022. In other embodiments, bedding portion 1006 may not have all of the features listed and/or may have other features instead of or in addition to those listed.

Bedding portion 1006, pocket 1008, strap 1010, and strap 1012 are embodiments of bedding portion 506, pocket 508, strap 510, and strap 512, respectively, described in conjunction with FIG. 5. Pocket 1008 corresponds to pocket 508 (FIG. 5), but is an embodiment of pocket 708 (FIG. 7A). FIG. 10, the distance from the top of the bed to pocket 1008, $d_{514}$ (FIG. 5), is one inch, and the distance from the closer end of the bed to pocket 1008, $d_{516}$, is 19 inches. Similarly, the height of pocket 1008, $H_{408}$ (FIG. 4), is 6.5 inches. Also, the width of strap 1010, $W_{510}$ (FIG. 5), is 2 inches, and the width of strap 1012, $W_{512}$ (FIG. 5), is 4 inches. Pocket 1008 is positioned at a distance from the end of the bed and has a height that is expected to be comfortable for an average sized adult. However, pocket 1008 has three sections. Pocket 1008 is an embodiment of pocket 708 (FIG. 7A) in which the width of section 1018, $L_1$ (FIG. 7A), is 15 inches, the width of section 1020, $L_2$ (FIG. 7A), is 8 inches, and the width of section 1022, $L_3$ FIG. 7A, is 5 inches.

Figure 11:
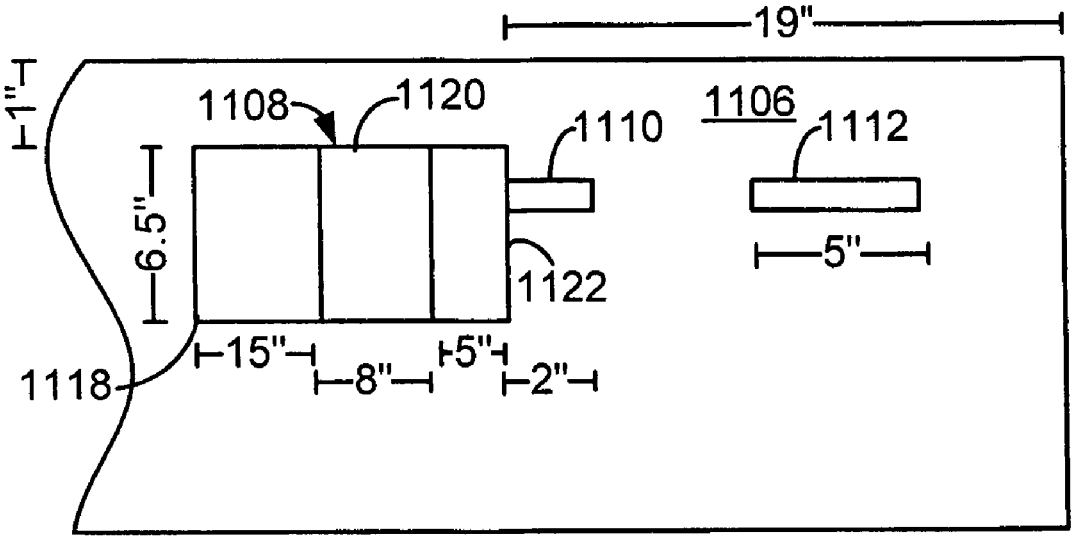
FIG. 11 shows a representation of an example of a portion of bedding having an embodiment of a set of attachments.

FIG. 11 shows a representation of an example of a bedding portion 1106 having an embodiment of a set of attachments. Bedding portion 1106 includes pocket 1108, strap 1110, strap 1112, and sections 1118, 1120, and 1122. In other embodiments, bedding portion 1106 may not have all of the features listed and/or may have other features instead of or in addition to those listed.

Bedding portion 1106 and strap 1110 are embodiments of bedding portion 506, pocket 508, and strap 510, respectively, described in conjunction with FIG. 5. Pocket 1108 corresponds to pocket 508, but is an embodiment of pocket 708 (FIG. 7A). Additionally, pocket 1108, strap 1110, and sections 1118, 1120, and 1122 are the same as pocket 1008, strap 1010, and sections 1018, 1020, and 1022, which were described in conjunction with FIG. 10. However, in contrast to strap 1012 of bedding portion 1006, strap 1112 is 5 inches instead of 4 inches wide.

Figure 12:
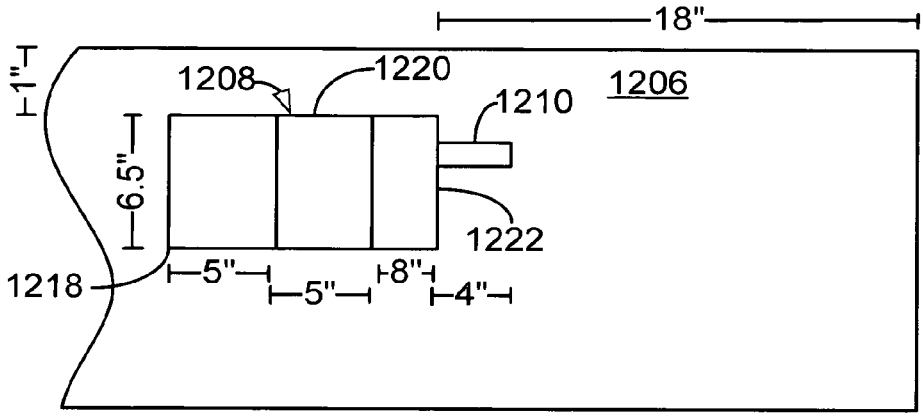
FIG. 12 shows a representation of an example of a portion of bedding having an embodiment of a set of attachments.

FIG. 12 shows a representation of an example of a bedding portion 1206 having an embodiment of a set of attachments. Bedding portion 1206 includes pocket 1208, strap 1210 sections 1218, 1220, and 1222. In other embodiments, bedding portion 1206 may not have all of the features listed and/or may have other features instead of or in addition to those listed.

Bedding portion 1206 and strap 1210 are embodiments of bedding portion 508, pocket 508, and strap 510, respectively, described in conjunction with FIG. 5. However, in the embodiment of FIG. 12 there is no strap that corresponds to strap 512. Also, pocket 1208 corresponds to pocket 508, but is an embodiment of pocket 708 (FIG. 7A). The height of pocket 1208, $H_{508}$ (FIG. 5), is 6.5 inches. The length of section 1218, $L_1$ (FIG. 7A), is 5 inches. The length of section 1220, $L_2$ (FIG. 7A), is 5 inches. The length of section 1222, $L_3$ (FIG. 7A), is 8 inches. The length of strap 1210, $W_{510}$ (FIG. 5) is 4 inches.

The distance from pocket 1208 to the closer edge (the head of the bed), $d_{514}$ (FIG. 5), is 18 inches. The distance from pocket 1208 to the top edge, $d_{516}$ (FIG. 5), is 1 inch.

Figure 13:
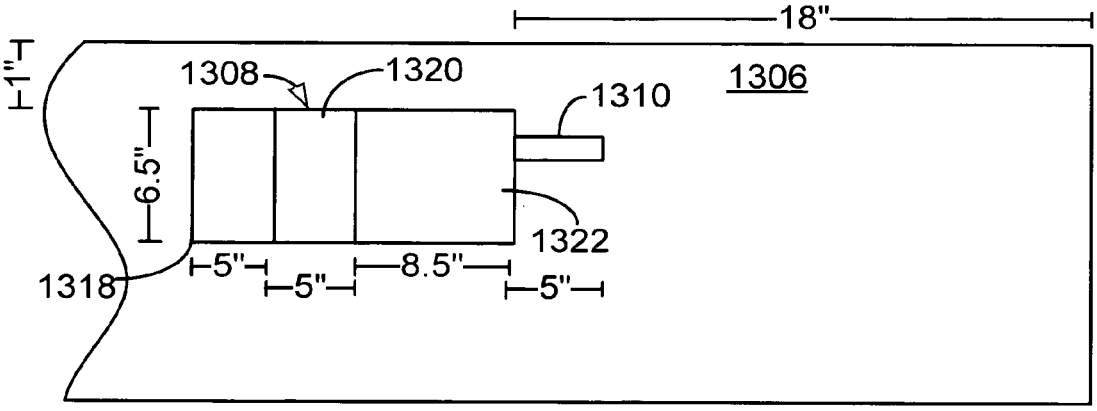
FIG. 13 shows a representation of an example of a portion of bedding having an embodiment of a set of attachments.

FIG. 13 shows a representation of an example of a bedding portion 1306 having an embodiment of a set of attachments. Bedding portion 1306 includes pocket 1308, strap 1310, section 1318, section 1320, and section 1322. In other embodiments, bedding portion 1306 may not have all of the features listed and/or may have other features instead of or in addition to those listed.

Bedding portion 1306 and strap 1310 are embodiments of bedding portion 506, pocket 508, and strap 510, respectively, described in conjunction with FIG. 5. However, in the embodiment of FIG. 13 there is no strap that corresponds to strap 512 (FIG. 5). Also, pocket 1308 corresponds to pocket 508 (FIG. 5), but is an embodiment of pocket 708 (FIG. 7A). Sections 1318, 1320, and 1322 are the same as sections 1218, 1220, and 1222, which were described in FIG. 12. Additionally, pocket 1308 and strap 1310 correspond to pocket 1208 and strap 1210, which were also described in conjunction with FIG. 12. However, section 1322 is 8.5 inches wide (instead of the 8 inches used for 1222) and strap 1310 is 5 inches long (instead of the 4 inches used for strap 1210). Similar to FIG. 12, the distance from pocket 1308 to the closer edge, $d_{514}$ (FIG. 5), is 18 inches. The distance from pocket 1308 to the top edge, $d_{516}$ (FIG. 5), is 1 inch.

Figure 14:
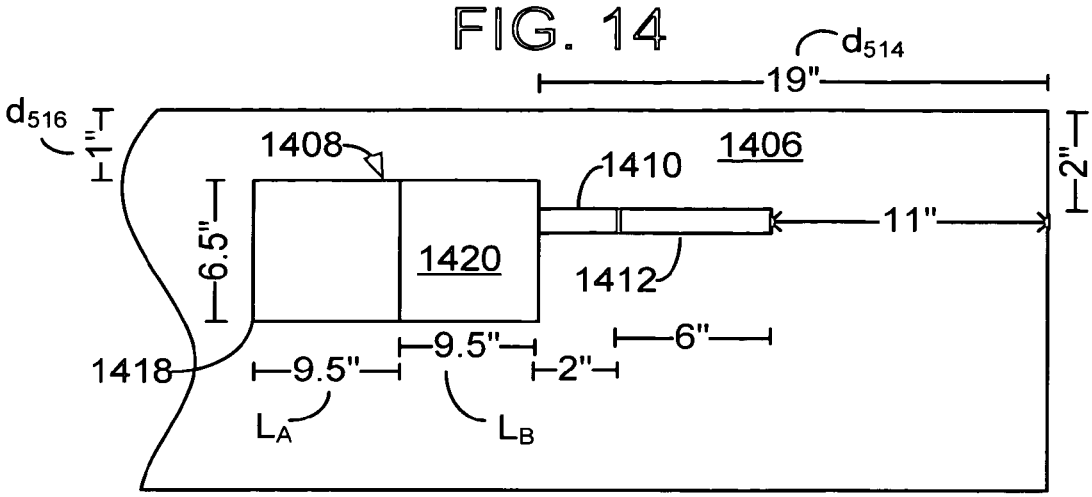
FIG. 14 shows a representation of an example of a portion of bedding having an embodiment of a set of attachments.

FIG. 14 shows a representation of an example of a bedding portion 1406 having an embodiment of a set of attachments. Bedding portion 1406 includes pocket 1408, strap 1410, and strap 1412. In other embodiments, bedding portion 1406 may not have all of the features listed and/or may have other features instead of or in addition to those listed.

Bedding portion 1406, strap 1410, and strap 1412 are embodiments of bedding portion 506, pocket 508, strap 510, and strap 512 respectively, described in conjunction with FIG. 5. Pocket 1408 corresponds to pocket 508, but is an embodiment of pocket 608 (FIG. 6), and sections 1418 and 1420 are embodiments of sections 618 and 620. In the embodiment of FIG. 14 the length of each of the pockets, $L_A$ and $L_B$ (FIG. 6), is 9.5 inches. The distance from pocket 1408 to the closer edge, $d_{514}$ (FIG. 5), is 19 inches. The distance from pocket 1408 to the top edge, $d_{516}$ (FIG. 5), is 1 inch. Strap 1410 is 2 inches wide similar to several other examples discussed above, but strap 1412 is 6 inches wide. Straps 1410 and 1412 are two separate straps that are adjacent to one another. In an alternative embodiment, straps 1410 and 1412 are replaced with one strap having two sections, one section that is 2 inches wide and another section that is 6 inches wide.

Figure 15:
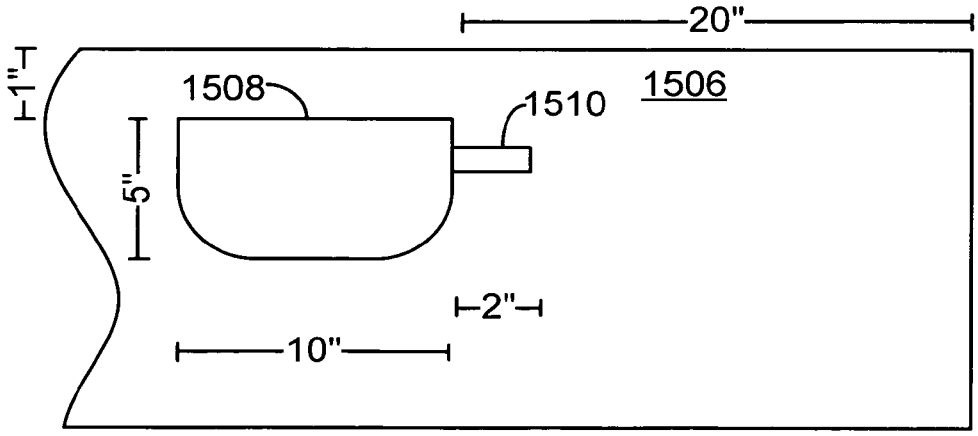
FIG. 15 shows a representation of an example of a portion of bedding having an embodiment of a set of attachments.

FIG. 15 shows a representation of an example of a bedding portion 1506 having an embodiment of a set of attachments. Bedding portion 1506 includes pocket 1508 and strap 1510. In other embodiments, bedding portion 1506 may not have all of the features listed and/or may have other features instead of, or in addition to, those listed.

Bedding portion 1506 and strap 1510 are embodiments of bedding portion 506 and strap 510, respectively, described in conjunction with FIG. 5. However, in the embodiment of FIG. 15 there is no strap that corresponds to strap 512 (FIG. 5). Also, pocket 1508 corresponds to pocket 508, but is an embodiment of pocket 730 (FIG. 7B), in which the corners of the pocket have been rounded. Pocket 1508 has a height, $H_{508}$ (FIG. 5), of 5 inches, and has a width, $W_{508}$ (FIG. 5), of 10 inches. Pocket 1508 is a distance, $d_{514}$ (FIG. 5), from the closer edge of 20 inches, and is a distance $d_{516}$ (FIG. 5), from the top edge of 1 inch. Strap 1510 has a width, $W_{510}$ (FIG. 5), of 2 inches wide.

Figure 16:
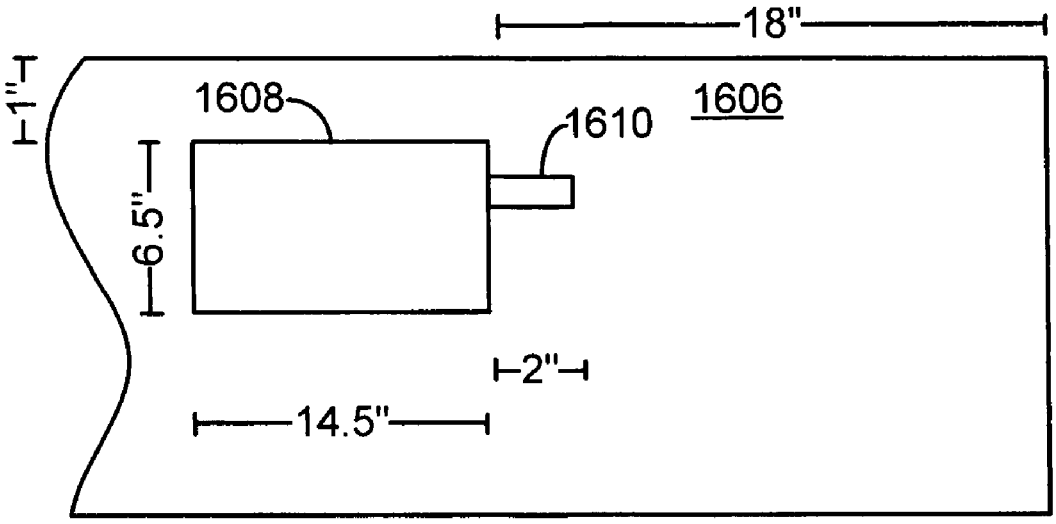
FIG. 16 shows a representation of an example of a portion of bedding having an embodiment of a set of attachments.

FIG. 16 shows a representation of an example of a bedding portion 1606 having an embodiment of a set of attachments. Bedding portion 1606 includes pocket 1608 and strap 1610. In other embodiments, bedding portion 1606 may not have all of the features listed and/or may have other features instead of or in addition to those listed.

Bedding portion 1606, pocket 1608, and strap 1610 are embodiments of bedding portion 506, pocket 508, and strap 510, respectively, described in conjunction with FIG. 5. However, in the embodiment of FIG. 16 there is no strap that corresponds to strap 512. Pocket 1608 has a height, $H_{508}$ (FIG. 5), of 6.5 inches, and has a width, $W_{508}$ (FIG. 5), of 14.5 inches. Pocket 1608 is a distance, $d_{514}$ (FIG. 5), from the closer edge of 18 inches, and is a distance $d_{516}$ (FIG. 5), from the top edge of 1 inch. Strap 1610 has a width, $W_{510}$ (FIG. 5), of 1 inch wide. The embodiment of FIG. 16 is similar to the embodiment of FIG. 9, except that the strap of FIG. 16 is 2 inches wide, whereas in the embodiment of FIG. 9 the strap is 4 inches wide. Also, the strap of FIG. 16 is between the pocket and the closest edge, whereas in FIG. 9 the pocket is between the strap and the closest edge.

Figure 17:
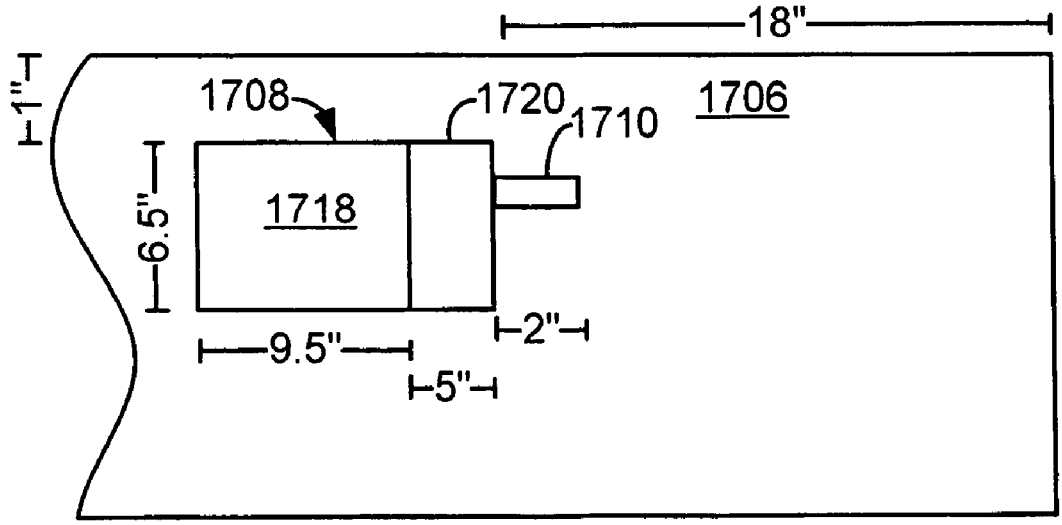
FIG. 17 shows a representation of an example of a portion of bedding having an embodiment of a set of attachments.

FIG. 17 shows a representation of an example of a bedding portion 1706 having an embodiment of a set of attachments. Bedding portion 1706 includes pocket 1708 and strap 1710. In other embodiments, bedding portion 1706 may not have all of the features listed and/or may have other features instead of or in addition to those listed.

Bedding portion 1706, pocket 1708, and strap 1710 are embodiments of bedding portion 506, pocket 508, and strap 510, respectively, described in conjunction with FIG. 5. Pocket 1708 is an embodiment of pocket 608 of FIG. 6 in which section 1718 is an embodiment of section 618 and has a width, $L_A$ (FIG. 6), of 9.5 inches. Similarly, section 1720 is an embodiment of section 620 and has a width, $L_B$ (FIG. 6), of 5 inches. Similar to FIG. 16, in the embodiment of FIG. 17 there is no strap that corresponds to strap 512 (FIG. 5). Similar to FIG. 16, pocket 1708 has a height, $H_{508}$ (FIG. 5), of 6.5 inches, and has a width, $W_{508}$ (FIG. 5), of 14.5 inches. Pocket 1708 is a distance, $d_{514}$ (FIG. 5), from the closer edge of 18 inches, and is a distance $d_{516}$ (FIG. 5), from the top edge of 1 inch. Strap 1710 has a width, $W_{510}$ (FIG. 5), of 2 inches wide.

In an embodiment, the bedding (e.g., a sheet) may be sold with a medium (e.g., a compact disc, piece of paper, or DVD) having instructions (e.g., audio, video, or text instructions) thereon. The instructions explain how to place and orient the bedding (e.g., how to place the bed sheet on the bed), such that the attachments are located near the head of bed on the side in which the user will be located. The instructions may also explain what size the people, beds, and pillows are expected to work best with the bedding. In an embodiment, the bedding is marked indicating a particular end is to be located at the head and/or foot of the bed to ensure that the attachments are located in a convenient location. In another embodiment the bedding (e.g., the sheet or the mattress) has attachments near all four corners so that no matter which way the bedding it oriented a set of attachments will be located in convenient reach of someone lying in the bed.

In an embodiment, the bedding is sold together in a kit including a pillow and/or pillow case that is intended to be used with the bedding and/or items that are intended to be stored in the attachments. For example, one of the attachments may be a strap that holds a water bottle, and the kit may include a water bottle that fits in the strap. As another example, one of the attachments may be a pocket with a section (e.g., a compartment) for a can of mace, a horn, a whistle, and/or a Taser® and the kit may include a can of mace, a horn, a whistle, and/or a Taser®, respectively.

FIG. 18 shows a top view of a representation of an example of a scenario 1800 in which a person is using a set of attachments. Scenario 1800 has mattress 1802, pillow 1804, person 1806, upper arm 1808, and forearm 1810, which are associated with dpocket, $d_{pillow}$, dupperarm, and $d_{forearm}$. In other embodiments, scenario 1800 may not have all of the features listed and/or may have other features instead of or in addition to those listed.

Scenario 1800 shows some factors that may be used to determine the location at which to place the pocket. Mattress 1802 may be the same as mattress 106. Pillow 1804 may be the same as pillow 110. Person 1806 is a person for which the location of a pocket is being determined. Upper arm 1808 is the upper arm of person 1806. Upper arm 1808 includes the shoulder of person 1806. Forearm 1810 is the forearm of person 1806. Distance $d_{pocket}$ is the distance from the edge of the bed where the head is placed to the location of the pocket. Distance $d_{pocket}$ is determined according to the location where the person 1806 would place their hand when reaching the side of mattress 1802. Distance $d_{pillow}$ is the distance from the edge of the bed where the head will be located to the shoulders of the person, which in some cases may be the edge of pillow 1804 that is furthest from the edge of mattress 1802. Distance $d_{upperarm}$ is the distance along the length of the bed that is subtended by upper arm 1808. $d_{upperarm}$ is significantly shorter than upper arm 1808, because upper arm 1808 extends in a direction that is nearly perpendicular with the direction that extends along the length of person 1806. Similarly, distance $d_{forearm}$ is the distance along the length of the mattress 1802 that is subtended by forearm 1810. The sum of $d_{pillow}$, $d_{upperarm}$, and $d_{forearm}$ is equal to $d_{pocket}$. Thus, by measuring $d_{pillow}$, $d_{upperarm}$, and $d_{forearm}$ the distance from the edge of the bed to the pocket, which is $d_{pocket}$, can be determined.

Some ways in which the person may reach the pocket are as follows. A person may sit in bed about as far from the side edge of the bed as when they are sleeping. In one embodiment, the person may lean against a headboard with one or more pillows between them and the headboard. Then to reach the pocket, the person may extend their arm diagonally towards the side of the bed. In this scenario, $d_{forearm}$ and $d_{upperarm}$ may be about 75% of the length of the forearm and upper arm (or between about 93% and 50% of the length of the forearm and upper arm), because the forearm and upper arm may make about a 30 degree (plus or minus about 15 degrees) angle with the bed and about a 30 degree (plus or minus about 15 degrees) angle with the edge of the bed. However, if the person sits up in bed, their upper arm may make about a 60 degree angle (plus or minus about 15 degrees) with the surface of the and with the edge of the bed. Consequently, the length $d_{upperarm}$ may only be about 25% of the length of the upper arm (or between about 6% and 50%).

In another embodiment, while the person is lying on their back, the person may extend the arm that is closest to the edge of the bed such that their elbow is either above the bed but near the edge or slightly beyond the edge of the bed (or anywhere in between). Then their forearm is extended a slight angle downwards allowing their hand to reach into a holder, such as a pocket. If no attachments are placed beyond this point, then the person will be able to reach the set of attachments while still lying down and without moving their entire body to the edge of the bed.

In yet another embodiment, the person moves their entire body to the edge of the bed, such that their shoulder is either slightly beyond the edge of the bed or over the bed, but next to the edge (or anywhere in between). Then the upper arm is extended forwards, along the edge of the bed at a slight angle to the top of the bed, and the forearm is extended alongside the bed and parallel to the length of the bed. For people that are comfortable and agile enough for this position, the furthest attachments of the set of attachments may be located such that the person may place items in and remove items from a holder while the person is in this position at the edge of the bed, which is significantly further from the head of the bed than the equivalent distances of the first two embodiments. Depending on the agility of the person for which the bedding is intended and the maximum degree of discomfort that the person is expected to be willing to experience when retrieving or storing items, one of these two locations may be used as an upper bound for the furthest from the head of the bed that a holder should be placed.

In an embodiment, while lying down, a person may also roll over one quarter of a roll and reach the side of the bed with their arm that is furthest from the edge of the bed having the set of attachments. The point where the person's hand can reach while rolled over one quarter of the way is approximately $d_{pillow}$ or slightly less than $d_{pillow}$. Alternatively, some people may be comfortable with sitting up in bed, placing themselves near the edge of the bed, and reaching downwards, possibly at a slight angle, to reach an item in a holder from the set of attachments. For such people, a holder may be located somewhat closer to the head of the bed (e.g., $d_{pillow}$ minus the amount the forearm and upper arm subtend along the length of the bed). The set of attachments may be located anywhere further away from the head of the bed than one of these two locations, depending on the agility of the population for which the set of attachments are intended (e.g., depending on whether that population can comfortably sit up in bed or roll over a one quarter roll in bed). For people that have difficulty sitting up, $d_{pillow}$ or slightly less may be the closest that any of the set of attachments should be placed to the head of the bed and for those that cannot sit up but can roll over, $d_{pillow}$ minus the sum of $d_{forearm}$ and $d_{upperarm}$ (which in this case may only be a small fraction of the length of the forearm and upper arm, respectively) may be the closest to the head of the bed that any of the attachments should be placed.

In order to make a bedding that has a set of attachments that is customized for a particular individual, the individual lies down on mattress 1802 in the manner in which that person usually lies in bed (e.g., using a pillow that is positioned where the person usually places the pillow and using a pillow of a size that the person usually uses), and an outline person is drawn onto a piece of material (e.g., a piece of bedding) that is under person 1806. Then, based on the outline, $d_{pocket}$ is determined, which may involve determining $d_{pillow}$, $d_{upperarm}$, and/or $d_{forearm}$ (also based on the outline). In an embodiment, instead of customizing the location of the set of attachments for a particular individual, the location is customized to a person of average dimensions relative to a particular population of people. For example, a person of average dimensions within a particular age group (e.g., an averaged dimensioned eight year old child) may be used for determining the location of a set of attachments for that age group (e.g., all eight year olds). The bedding may be sold with an indication as to the population of people (e.g., the age group) that are expected to find the location of the set of attachments comfortable.

FIG. 19 shows side view 1900 of scenario 1800, having mattress 1802, pillow 1804, person 1806, upper arm 1808, forearm 1810, and pocket 1902, which are associated with $d_{pocket}$, $d_{pillow}$, $d_{upperarm}$, and $d_{forearm}$. In other embodiments, side view 1900 may not have all of the features listed and/or may have other features instead of or in addition to those listed.

Mattress 1802, pillow 1804, person 1806, upper arm 1808, forearm 1810, dpocket, $d_{pillow}$, $d_{upperarm}$, and $d_{forearm}$ were discussed in conjunction with FIG. 18, above. Side view 1900 is a side view of scenario 1800 in which set of attachments 1902 is visible. Set of attachments 1902 may be any of the attachments discussed in this specification. In an embodiment, the further end of set of attachments 1902 is at about the end of (e.g., within an ⅛ of an inch of) where person 1806 is capable of reaching while lying down. Then $d_{forearm}$ is somewhat shorter than the length of the forearm 1810, because forearm 1810 is angled slightly downward and somewhat outward while reaching into set of attachments 1902. For use while lying down, as a rough approximation, $d_{pocket}$ is roughly $d_{pillow}$ plus the length of the forearm, because $d_{forearm}$ is slightly less than the length of forearm 1810, but $d_{upperarm}$ makes up for the difference. However, this is only a rough approximation, because $d_{upperarm}$ is usually significantly greater than the difference between $d_{forearm}$ and the length of forearm 1810.

Figure 20:
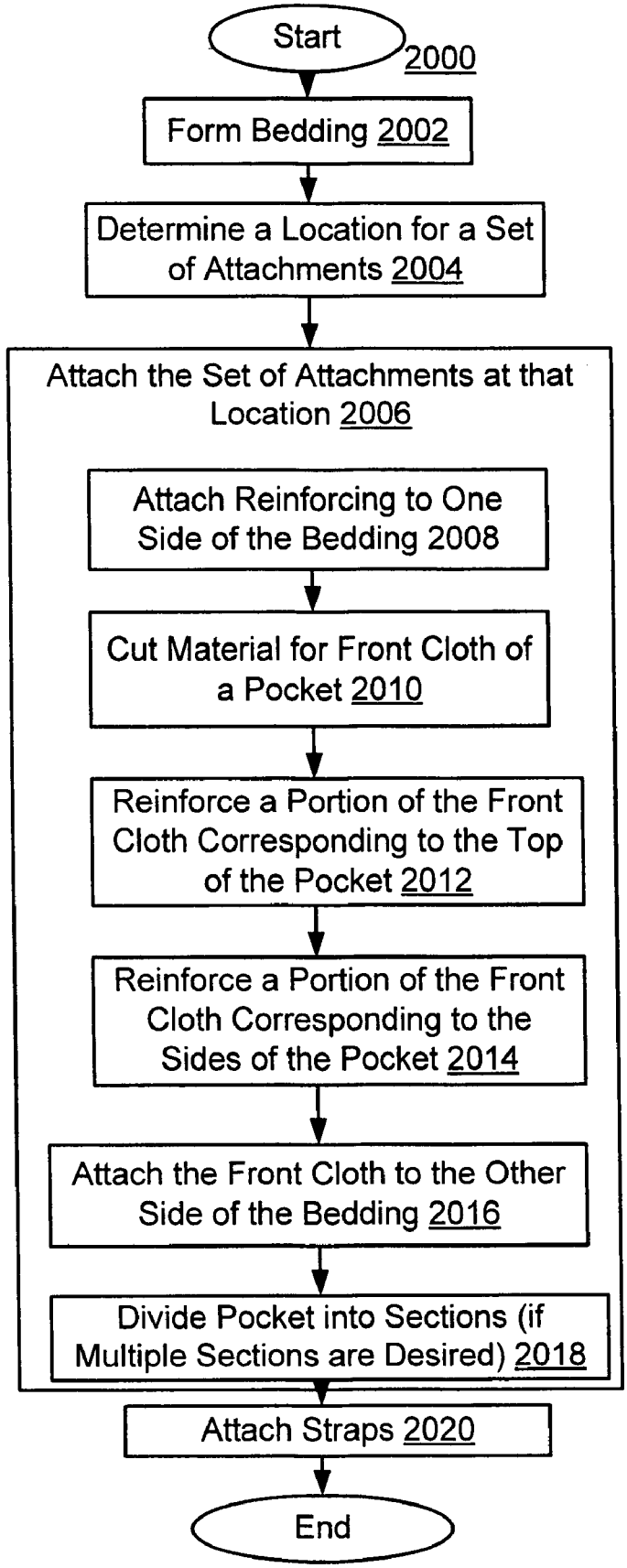
FIG. 20 is a flowchart of an example of a method of making bedding having one of the sets of attachments discussed in this specification.

FIG. 20 is a flowchart of an example of a method of making bedding having one of the sets of attachments discussed in this application. In step 2002 a piece of bedding to which the set of attachments will be attached is formed. If the piece of bedding is a mattress, the mattress is formed. If the piece of bedding is a blanket or bedspread, the blanket or bedspread is formed. If the piece of bedding is a sheet, a piece of fabric is cut to a desired shape (e.g., a rectangle) according to the mattress for which it is designed. Hems may be formed at one or more edges of the sheet to prevent tearing. If the piece of bedding is a fitted sheet for a rectangular bed, a rectangular piece of material is cut, the corners may be cut out, and then sewn together forming a sheet that has the shape of a mattress. Then, elastic may be attached to the bottom of edge of the fitted sheet.

In step 2004, the location of the set of attachments is determined. Step 2004 may involve determining $d_{pocket}$, which in turn may involve determining $d_{pillow}$, $d_{upperarm}$, and $d_{forearm}$. The distance $d_{pillow}$ may be determined by determining the dimensions of the pillow, by determining the size of the pillow that an average person normally uses, an average person of a particular population normally uses, and/or where that person's shoulders will be when reclining in bed, or that a particular person normally uses (for a customized location). The distances $d_{upperarm}$ and $d_{forearm}$ may be determined based on the dimensions of an average person, an average person of a particular population (and of a particular agility), or of a particular person (for a customized location).

In step 2006, the set of attachments is attached to the piece of bedding at the location determined by step 2004, which may involve attaching one or more pockets and/or straps to the piece of bedding. Step 2006 may involve three sub-steps. In sub-step 2008, optionally, a piece of material may be cut to a size that is about the desired size of the pocket and/or strap, respectively, and the piece of material may be sewn to one side of the bedding, as reinforcement.

Then, in sub-step 2010, a piece of material may be cut to a size that is larger than the desired size of the pocket and/or strap.

In sub-step 2012, if a pocket is being attached, a hem may be formed at the top of the piece of material. Then in sub-step 2014, the side edges may be folded over to reinforce the sides. Next in sub-step 2016, the side edges and bottom of the piece of material are sewn to the bedding. If the backing is present, the piece of material is sewn on the opposite side of the bedding as the backing, but the piece of material is sewn onto the backing, so that the backing, bedding, and front are arranged in a configuration similar to that shown in FIG. 7C. If a pocket is being made, and if the pocket is intended to have multiple sections, in sub-step 2018, one or more lines on the front are sewn or otherwise attached to the bedding, where the lines extend up and down the pocket and separate the pocket into sections (e.g., compartments).

If the set of attachments include straps not yet attached in the earlier steps, in sub-step 2020, one or more straps are attached to the bedding. Sub-step 2020 may involve folding the ends of the strap and then sewing the ends of the strap to the bedding at the folded regions. Additionally or alternatively, the tacks may secure the ends of the strap to the bedding. If backing material was attached to the other side of the bedding in the vicinity where the strap is supposed to be located, the strap may be sewn to the backing.

In an embodiment, each of the steps of method 2000 is a distinct step. In another embodiment, although depicted as distinct steps in FIG. 20, step 2002-2020 may not be distinct steps. In other embodiments, method 2000 may not have all of the above steps and/or may have other steps in addition to or instead of those listed above. The steps of method 2000 may be performed in another order. Sub-steps of the steps and sub-steps of the sub-steps listed above as part of method 2000 may be used to form their own method.

In an embodiment, a kit may be sold or given to people wanting a customized bed sheet with recorded information that is useful in preparing the customized bed sheet. The kit may include a sheet, a marker for marking the sheet, and a medium (e.g., a compact disc, piece of paper, or DVD) having instructions (e.g., audio, video, or text instructions) thereon. The instructions explain how to mark the sheet to indicate a positioning of a particular individual while the individual is lying on the sheet and reaching for an item on a side of the bed.

Figure 21:
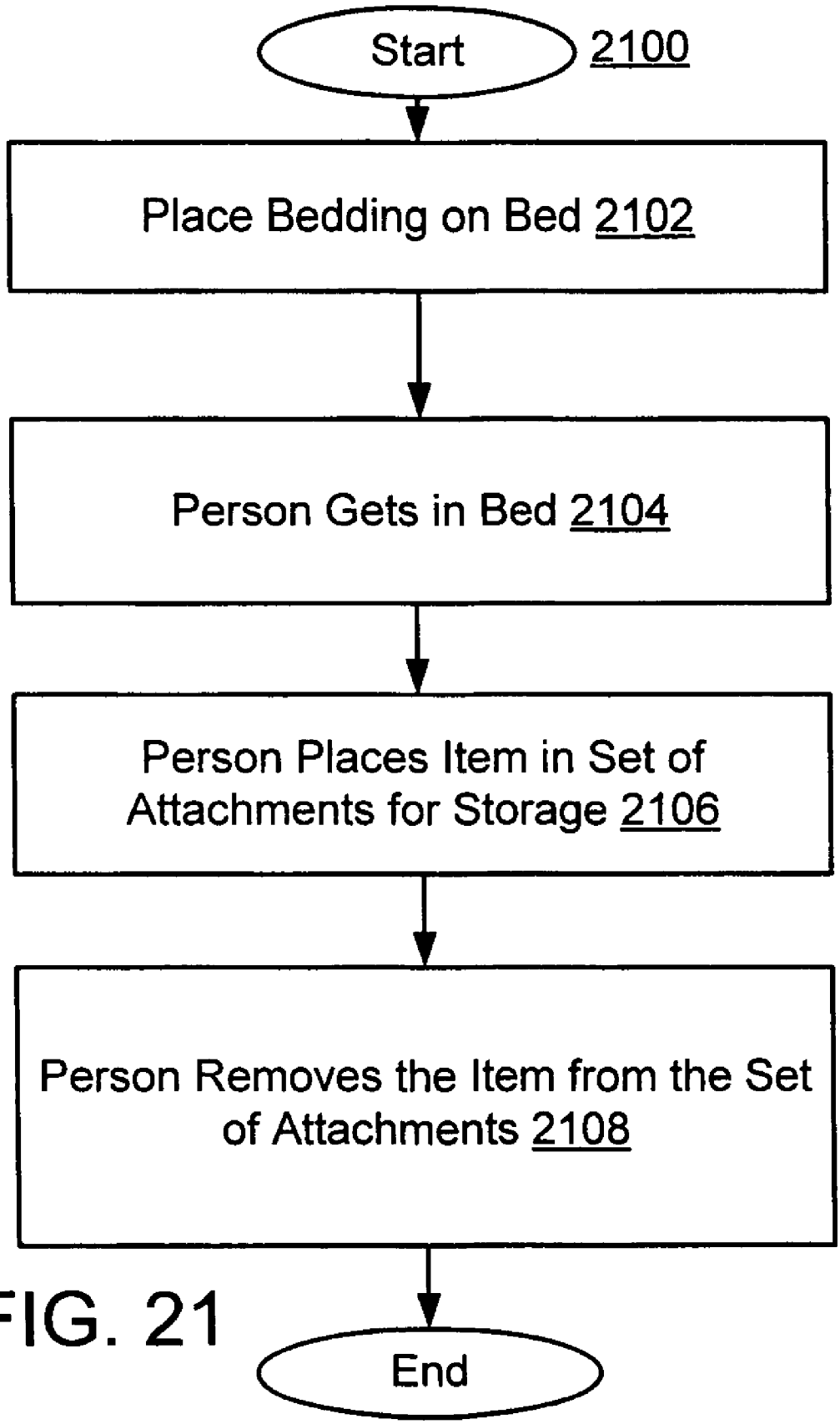
FIG. 21 shows a flowchart of an example of a method of using one of the set of attachments discussed in this specification.

FIG. 21 shows a flowchart of an example of a method of using the set of attachments. In step 2102, the bedding (e.g., a fitted sheet) having a set of attachment is placed on a mattress, unless the bedding is a mattress. In step 2104, a person gets into (e.g., sits in a reclining position) in the bed. In step 2106, while (e.g., in the reclining position) in bed, the person places an item in a holder of the set of attachments. Step 2106 may involve the person extending their arm diagonally (e.g., making about a 30 degree angle with the surface of the bed and a 30 degree angle with the side of the bed), and placing the item into the holder. Step 2106 may include the person storing the item in the holder for a desired period of time. In step 2108, while reclining in bed, the person removes the item from the holder. Step 2108 may involve the person extending their arm until the elbow and forearm is slightly beyond the edge of the bed (similar to step 2106), angling the forearm slightly downwards (similar to step 2106), optionally reaching into the holder (depending on the nature of the item and its relationship to the holder), and removing the item in the holder (in contrast to step 2106). In an alternative embodiment method 2100 may be performed with the person lying down instead of reclining in bed.

In an embodiment, each of the steps of method 2100 is a distinct step. In another embodiment, although depicted as distinct steps in FIG. 21, step 2102-2108 may not be distinct steps. In other embodiments, method 2100 may not have all of the above steps and/or may have other steps in addition to or instead of those listed above. The steps of method 2100 may be performed in another order. Sub-steps of the steps listed above as part of method 2100 may be used to form their own method.

Each embodiment disclosed herein may be used or otherwise combined with any of the other embodiments disclosed. Any element of any embodiment may be used in any embodiment.

Although the invention has been described with reference to specific embodiments, it will be understood by those skilled in the art that various changes may be made and equivalents may be substituted for elements thereof without departing from the true spirit and true scope of the invention. In addition, modifications may be made without departing from the essential teachings of the invention.

In the claims

1. A system comprising:

a fitted bed sheet, the fitted bed sheet having a top section, four side sections, each of the four side sections having a top, two sides, and a bottom, and an elastic strip;

the top section of the fitted bed sheet is connected to the four side sections at the top of each side section, each of the four side sections being connected to two other side sections of the four side section at the sides of the side section;

the elastic strip connected to each of the four side sections at the bottom of the side section;

a first piece of material attached to the bed sheet forming a pocket for storing items, which is positioned on one of the four side sections of the fitted bed sheet, the location of the piece of material being based on dimensions of an average sized person and on dimensions of the bed sheet;

the first piece of material having at least one edge that forms a top opening of the pocket, which will be referred to as a top pocket-edge, the top pocket-edge being straight, horizontal, 14.5 inches wide, and parallel to a top surface of the bed when the fitted sheet is fitted onto a mattress on a bed;

the first piece of material having a first side edge and a second side edge, which are each 5 inches high, the first side edge of the first material having at least a portion that is closed, straight, parallel to at least a portion of the second side edge, and perpendicular to the top opening;

the portion of the second side-edge of the first piece of material to which the first edge is parallel is also straight, the second edge of the first piece of material is also closed;

a bottom edge, of the first piece of material, that is closed, and has at least a portion that is straight, and parallel to the top;

the first piece of material being sewn to lie flat against the fitted sheet such that when the fitted sheet is on a mattress, tension pulling the fitted sheet to fit on the mattress tends to pull the pocket closed, the first piece of material is on a side of the fitted sheet that is designed to face away from the bed; and a second piece of material having a height of height of $1/8^{th}$ of an inch to a ½ of an inch and a width 4 inches;

the second piece of material being attached to the bed sheet forming a strap for holding items, which is adjacent to the pocket;

the second piece of material having at least one edge that forms a top opening of the strap, which will be referred to as a top strap-edge, the top-strap edge being straight, horizontal, and parallel to the top surface of the bed when the fitted sheet is fitted onto the mattress on the bed;

the second piece of material having a first side edge and a second side edge, the second piece of material being fastened to the fitted bed sheet at a region closer the first edge than a center of the second piece of material, the second piece of material also being fastened to the fitted bed sheet at a region closer the second edge than the center of the strap;

a bottom edge that is open, straight, and parallel to the top of the second piece of material;

the second piece of material also being sewn to lie flat against the fitted sheet such that when the fitted sheet is on a mattress, tension pulling the fitted sheet to fit on the mattress tends to pull the strap closed.

2. The system of claim 1, the first piece of material that forms the pocket is located at a distance of 1 inch away from a location that corresponds to a portion of the bed sheet that is expected to be placed on a top of a bed.

3. The system of claim 1, the location of the first piece of material on the bed sheet is such that when the bed sheet is placed on a bed in an expected manner, an averaged sized person can comfortably reach the item stored while sitting up in a reclined position at a location in the bed where an average person sleeps.

4. The system of claim 1, one of the first side edge and the second side edge of the first piece of material being located 16 inches from an edge of the bed where two side sections of the fitted bed sheet meet.

5. The system of claim 1, the top strap-edge of the second piece of material being located 1 to 2 inches below the top pocket-edge of the first piece of material.

6. A system comprising:

a fitted bed sheet, the fitted bed sheet having a top section, four side sections, each of the four side sections having a top, two sides, and a bottom, and an elastic strip;

the top section of the fitted bed sheet is connected to the four side sections at the top of each side section, each of the four side sections being connected to two other side sections of the four side section at the sides of the side section;

the elastic strip connected to each of the four side sections at the bottom of the side section;

a pocket attached to the bed sheet forming a plurality of pocket sections for storing items, the pocket is positioned on one of the four sides of the fitted bed sheet, the location of the pocket being based on dimensions of an average sized person and on dimensions of the bed sheet;

the pocket having at least a top edge that forms a top opening of the pocket, the top edge of the pocket being straight, horizontal, and parallel to a top surface of the bed when the fitted sheet is fitted onto a mattress on a bed;

the pocket being sewn to lie flat against the fitted sheet such that when the fitted sheet is on the mattress;

tension pulling the fitted sheet to fit on the mattress tends to pull the pocket closed; the pocket is on a side of the fitted sheet that is designed to face away from the bed;

the pocket having a height of 6.5 inches, a first side edge and a second side edge, the first side edge of the pocket having
at least a portion that is
closed,
straight,
parallel to at least a portion of the second side edge, and
perpendicular to the top opening;
the portion of the second side-edge of the pocket to which the first edge is parallel is also straight;
the second edge of the pocket is also closed;
a bottom edge, of the pocket, that
is closed,
has at least a portion that is
straight, and
parallel to the top edge of the pocket; and
the plurality of pocket sections including two pocket sections each having a pocket structure that forms a pouch and are formed side by side and touching one another;
the pocket structure of each pocket section having two sides that are closed and each pocket section sharing a portion of the bottom edge of the pocket;
the width of the pocket being 14.5 inches wide, the two pocket sections including a larger pocket section that is 9.5 inches wide and a smaller pocket section that is 5 inches wide;
a piece of material forming a strap having a height of height of $\frac{1}{8}^{th}$ of an inch to a ½ of an inch and a width 2 inches;
the piece of material being attached to the fitted bed sheet forming a strap for holding items, which is adjacent to the pocket;
the piece of material having at least a top edge that forms a top opening of the strap, which will be referred to as a top strap-edge, the top strap-edge, being straight, horizontal, and parallel to the top surface of the bed when the fitted sheet is fitted onto the mattress on the bed;
the piece of material having
a first side edge and a second side edge, the strap being fastened to the fitted bed sheet at a region closer the first edge than a center of the strap, the strap also being fastened to the fitted bed sheet at a region closer the second edge than the center of the strap;
a bottom edge that is
open,
straight, and
parallel to the top strap-edge; and
the piece of material also being sewn to lie flat against the fitted sheet such that when the fitted sheet is on a mattress, tension pulling the fitted sheet to fit on the mattress tends to pull the strap closed.

7. The system of claim 6, one of the first side edge and the second side edge of the first piece of material being located 18 inches from an edge of the bed where two side sections of the fitted bed sheet meet.

8. The system claim 6, the top opening of the pocket being 1 inch from the top of the bed when the fitted bed sheet is on the bed.

9. The system of claim 6, the top strap-edge of the piece of material being located 1 to 2 inches below the top pocket-edge of the pocket.

10. A system comprising:
a fitted bed sheet, the fitted bed sheet having
a top section,
four side sections, each of the four side sections having a top, two sides, and a bottom, and
an elastic strip;
the top section of the fitted bed sheet is connected to the four side sections at the top of each side section, each of the four side sections being connected to two other side sections of the four side section at the sides of the side section;
the elastic strip connected to each of the four side sections at the bottom of the side section;
a pocket attached to the bed sheet forming a plurality of pockets sections for storing items, the pocket is positioned on the one of the four sides of the fitted bed sheet, the location of the pocket being based on dimensions of an average sized person and on dimensions of the bed sheet;
the pocket having at least a top edge that forms a top opening of the pocket, the edge being straight, horizontal, and parallel to a top surface of the bed when the fitted sheet is fitted onto a mattress on a bed;
the pocket being sewn to lie flat against the fitted sheet such that when the fitted sheet is on a mattress,;
tension pulling the fitted sheet to fit on the mattress tends to pull the pocket closed, the pocket is on a side of the fitted sheet that is designed to face away from the bed;
the pocket having
a height of 6.5 inches,
a first side edge and a second side edge, the first side edge of the pocket having at least a portion that is
closed,
straight,
parallel to at least a portion of the second side edge of the pocket, and
perpendicular to the top edge of the pocket;
the portion of the second side-edge of the pocket to which the first edge is parallel is also straight;
the second edge of the pocket of material is also closed;
a bottom edge, of the pocket, that
is closed,
has at least a portion that is
straight and
parallel to the top edge of the pocket; and
the pocket including three pockets sections formed side by side and touching one another, each pocket section having a pocket structure forming a pouch;
the pocket structure of each pocket section having two sides that are closed and each pocket section sharing a portion of the bottom edge of the pocket;
the width of the pocket being 28 inches wide, the three pocket sections including a first pocket section that is 15 inches wide, a second pocket section that is 8 inches wide, and a third pocket section that is 5 inches wide;
a strap having a height of height of $\frac{1}{8}^{th}$ of an inch to a ½ of an inch and a width 2 inches;
the strap being attached to the bed sheet forming a strap for holding items, which is adjacent to the pocket,
the strap having at least one edge that forms a top opening of the strap, which will be referred to as a top strap-edge, the top-strap edge being straight, horizontal, and parallel to the top surface of the bed when the fitted sheet is fitted onto the mattress on the bed,
the strap having
a first side edge and a second side edge, the strap being fastened to the fitted bed sheet at a region closer the first edge than a center of the strap, the strap also being fastened to the fitted bed sheet at a region closer the second edge than the center of the strap;
a bottom edge that
is open,
that is straight and parallel to the top the strap also being sewn to lie flat against the fitted sheet such that when the fitted sheet is on a mattress, tension pulling the fitted sheet to fit on the mattress tends to pull the strap closed.

11. The system of claim 10, one of the first side edge and the second side edge of the pocket being located 18 inches from an edge of the bed where two side sections of the fitted bed sheet meet.

12. The system claim 10, the top opening of the pocket being 1 inch from the top of the bed when the fitted bed sheet is on the bed.

13. The system of claim 10, the top strap-edge of the piece of material being located 1 to 2 inches below the top pocket-edge of the pocket.

14. A system comprising:

a fitted bed sheet, the fitted bed sheet having a top section, four side sections, each of the four side sections having a top, two sides, and a bottom, and an elastic strip;

the top section of the fitted bed sheet is connected to the four side sections at the top of each side section, each of the four side sections being connected to two other side sections of the four side section at the sides of the side section;

the elastic strip connected to each of the four side sections at the bottom of the side section; and a pocket attached to the bed sheet forming a plurality of pocket sections for storing items, which is positioned on the one of the four sides of the fitted bed sheet, the location of the pocket being based on dimensions of an average sized person and on dimensions of the bed sheet, the pocket having at least one edge that forms a top opening of the pocket, the edge being straight, horizontal, and parallel to a top surface of the bed when the fitted sheet is fitted onto a mattress on a bed, the pocket being sewn to lie flat against the fitted sheet such that when the fitted sheet is on a mattress, tension pulling the fitted sheet to fit on the mattress tends to pull the pocket closed, the pocket is on a side of the fitted sheet that is designed to face away from the bed, the pocket having a height of 6.5 inches, a first side edge and a second side edge, the first side edge of the first material having at least a portion that is closed, straight, parallel to at least a portion of the second side edge, and perpendicular to the top opening;

the portion of the second side edge of the pocket to which the first edge is parallel is also straight;

the second side edge of the pocket is also closed;

a bottom edge, of the pocket, that is closed, has at least a portion that is straight, and parallel to the top of the pocket; and the plurality of pocket sections including three pocket sections formed side by side and touching one another, each pocket section having a pocket structure that forms a pouch;

the pocket structure of each pocket section having two sides that are closed and each pocket section sharing a portion of the bottom edge of the pocket;

the width of the pocket being 18.5 inches wide, the three pocket sections including a first pocket section that is 5 inches wide, a second pocket section that is 5 inches wide, and a third pocket section that is 8.5 inches wide;

a strap having a height of height of $\frac{1}{8}^{th}$ of an inch to a ½ of an inch and a width 5 inches;

a piece of material being attached to the bed sheet forming a strap for holding items, which is adjacent to the pocket, the piece of material having at least a top edge that forms a top opening of the strap, which will be referred to as a top strap-edge, the top-strap edge being straight, horizontal, and parallel to the top surface of the bed when the fitted sheet is fitted onto the mattress on the bed, the piece of material having a first side edge and a second side edge, the strap being fastened to the fitted bed sheet at a region closer the first edge than a center of the strap, the strap also being fastened to the fitted bed sheet at a region closer the second edge than the center of the strap;

a bottom edge that is open, straight, and parallel to the top of the piece of material;

the piece of material also being sewn to lie flat against the fitted sheet such that when the fitted sheet is on a mattress, tension pulling the fitted sheet to fit on the mattress tends to pull the strap closed.

15. The system of claim 14, one of the first side edge and the second side edge of the pocket being located 18 inches from an edge of the bed where two side sections of the fitted bed sheet meet.

16. The system claim 14, the top edge of the pocket being 1 inch from the top of the bed when the fitted bed sheet is on the bed.

17. The system of claim 14, the top strap-edge of the piece of material being located 1 to 2 inches below the top pocket-edge of the pocket.

* * * * *